US010019961B2

(12) United States Patent
Kabe et al.

(10) Patent No.: US 10,019,961 B2
(45) Date of Patent: Jul. 10, 2018

(54) DISPLAY DEVICE

(71) Applicant: Japan Display Inc., Tokyo (JP)

(72) Inventors: Masaaki Kabe, Tokyo (JP); Hiroki Uchiyama, Tokyo (JP); Toshiaki Fukushima, Tokyo (JP); Gen Koide, Tokyo (JP)

(73) Assignee: Japan Display Inc., Tokyo (JP)

( * ) Notice: Subject to any disclaimer, the term of this patent is extended or adjusted under 35 U.S.C. 154(b) by 397 days.

(21) Appl. No.: 14/716,240

(22) Filed: May 19, 2015

(65) Prior Publication Data

US 2015/0348489 A1 Dec. 3, 2015

(30) Foreign Application Priority Data

Jun. 3, 2014 (JP) ..... 2014-115175

(51) Int. Cl.
*G09G 3/36* (2006.01)
*G09G 5/18* (2006.01)
*G09G 3/20* (2006.01)

(52) U.S. Cl.
CPC ..... *G09G 3/3696* (2013.01); *G09G 3/20* (2013.01); *G09G 3/2003* (2013.01);
(Continued)

(58) Field of Classification Search
CPC ... G09G 2300/0452; G09G 2320/0242; G09G 2300/0465; G02F 2201/52
See application file for complete search history.

(56) References Cited

U.S. PATENT DOCUMENTS 6,545,653 B1 4/2003 Takahara et al.
7,362,393 B2 4/2008 Kim et al.
(Continued)

FOREIGN PATENT DOCUMENTS

CN 101819337 A 9/2010
CN 102142221 A 8/2011
(Continued)

OTHER PUBLICATIONS

Korean Office Action dated Apr. 14, 2016 for corresponding Korean Application No. 10-2015-0077347.
(Continued)

*Primary Examiner* — Priyank Shah
(74) *Attorney, Agent, or Firm* — Michael Best & Friedrich LLP

(57) ABSTRACT

A display device includes an image display panel and a control device. The image display panel includes first sub-pixels, second sub-pixels, third sub-pixels, and fourth sub-pixels in which a specified sub-pixel column including the third sub-pixels and the fourth sub-pixels and at least one other sub-pixel column arranged next to the specified sub-pixel column are periodically arranged. The control device performs column inversion driving to apply a voltage having the same polarity to signal lines of a first specified sub-pixel column belonging to the specified sub-pixel columns and the other sub-pixel column adjacent to the first specified sub-pixel column, apply a voltage having the same polarity as the first specified sub-pixel column to one of the signal lines of a second specified sub-pixel column and a third specified sub-pixel column adjacent to the first specified sub-pixel column, and invert the polarities of the voltages to be applied at predetermined cycles.

8 Claims, 25 Drawing Sheets

(52) U.S. Cl.
CPC ..... *G09G 3/3614* (2013.01); *G09G 5/18* (2013.01); *G09G 2300/0426* (2013.01); *G09G 2300/0452* (2013.01); *G09G 2300/0465* (2013.01); *G09G 2330/021* (2013.01); *G09G 2340/0457* (2013.01)

(56) References Cited

U.S. PATENT DOCUMENTS

| | | | | |
|---|---|---|---|---|
| 2004/0169807 | A1* | 9/2004 | Rho | G02F 1/133514 349/139 |
| 2006/0262251 | A1* | 11/2006 | Kim | G02F 1/133514 349/106 |
| 2008/0278466 | A1* | 11/2008 | Joo | G09G 3/3614 345/205 |
| 2009/0322802 | A1 | 12/2009 | Noguchi et al. | |
| 2010/0220089 | A1 | 9/2010 | Peng et al. | |
| 2010/0231564 | A1 | 9/2010 | Min et al. | |
| 2011/0181634 | A1 | 7/2011 | Higashi et al. | |
| 2013/0222442 | A1* | 8/2013 | Gu | G09G 5/02 345/694 |
| 2014/0204072 | A1 | 7/2014 | Yamaguchi et al. | |

FOREIGN PATENT DOCUMENTS

| | | | |
|---|---|---|---|
| CN | 102376279 | A | 3/2012 |
| JP | 05-043118 | B2 | 6/1993 |
| JP | 08-292419 | A | 11/1996 |
| JP | 2010-033014 | A | 2/2010 |
| JP | 2014-160232 | A | 9/2014 |
| KR | 10-2004-0000580 | A | 1/2004 |
| KR | 10-2010-0102333 | A | 9/2010 |
| KR | 10-2011-0088400 | A | 8/2011 |

OTHER PUBLICATIONS

Chinese Office Action dated Apr. 24, 2017 for corresponding Chinese Application No. 201510294142.8.

* cited by examiner

DISPLAY DEVICE

CROSS-REFERENCE TO RELATED APPLICATIONS

This application claims priority from Japanese Application No. 2014-115175, filed on Jun. 3, 2014, the contents of which are incorporated by reference herein in its entirety.

BACKGROUND

1. Technical Field

The present disclosure relates to a display device.

2. Description of the Related Art

In recent years, demand has been increased for display devices, for example, for mobile apparatuses such as a cellular telephone and electronic paper. In such display devices, each one pixel includes a plurality of sub-pixels that output different colors. Various colors are displayed using the single pixel by switching on and off display at the sub-pixels. Display characteristics such as resolution and luminance have been improved year after year in such display devices. However, an aperture ratio is reduced as the resolution increases, so that luminance of a backlight needs to be increased to achieve high luminance. An increase of the luminance of a backlight increases power consumption of backlight. To solve this problem, a technique has been developed for adding a white pixel serving as a fourth sub-pixel to red, green, and blue sub-pixels known in the art (for example, refer to Japanese Patent Application Laid-open Publication No. 2010-33014 (JP-A-2010-33014)). According to this technique, the white pixel enhances the luminance, contributing to lowering the current value of the backlight apparatus and reducing the power consumption.

Examples of a known driving method for an image display panel include, but are not limited to, a column inversion driving method, a line inversion driving method, a dot inversion driving method, and a frame inversion driving method. The column inversion driving method is a driving method for applying voltages so that one line (column) and another line adjacent thereto among lines each composed of sub-pixels or pixels including combined sub-pixels, can be different in potential relative to a reference potential, and inverting the polarities of the voltages to be applied at predetermined cycles. Accordingly, it is known that charge and discharge amounts are small in a signal line and low power consumption is achieved in the column inversion driving method as compared with the dot inversion driving method (for example, refer to Japanese Examined Patent Application Publication No. H5-43118).

An image display panel to which the fourth sub-pixel is added involves increase of an area per pixel, so that such an image display panel with higher definition has been demanded. Accordingly, liquid crystal display panels have been studied that have an arrangement configuration in which: first columns each including first sub-pixels, second columns each including second sub-pixels, and third columns each including third sub-pixels and the fourth sub-pixels are sequentially arranged; in each of the third columns, the third sub-pixels and the fourth sub-pixels are alternately arranged in a column direction; and, across the third columns, in the same row, the third sub-pixels and the fourth sub-pixels are alternately arranged so that each adjacent two of the third columns in a direction along a row direction may contain the third sub-pixel and the fourth sub-pixel. In such a configuration, however, although a pixel area can be prevented from being increased and high definition can be achieved even when the fourth sub-pixel is added, deterioration in display quality called crosstalk may be caused when the technique disclosed in Japanese Examined Patent Application Publication No. H5-43118 is applied to further suppress the power consumption.

For the foregoing reasons, there is a need for a display device that suppresses power consumption and reduces deterioration in display quality.

SUMMARY

According to an aspect, a display device includes: an image display panel including: a plurality of pixels arranged in a pixel array including first sub-pixels, second sub-pixels, third sub-pixels, and fourth sub-pixels. The plurality of pixels includes therein, a specified sub-pixel column including the third sub-pixels and the fourth sub-pixels, and at least one sub-pixel column of other sub-pixel columns arranged next to the specified sub-pixel column. The specified sub-pixel column and the one other sub-pixel column are periodically arranged. The display device also includes: a plurality of signal lines provided to the specified sub-pixel columns and the other sub-pixel columns; and a control device that controls the pixels based on image signals. In each of the specified sub-pixel columns, the third sub-pixel and the fourth sub-pixel are alternately arranged in a direction along the corresponding specified sub-pixel column, and the third sub-pixel and the fourth sub-pixel are alternately arranged in a direction along the row direction in each adjacent two of the specified sub-pixel columns. The control device performs column inversion driving (i) to apply a voltage having the same polarity to the signal lines of a first specified sub-pixel column belonging to the specified sub-pixel columns and the other sub-pixel column adjacent to the first specified sub-pixel column, (ii) to apply a voltage having the same polarity as the first specified sub-pixel column to one of the signal lines of a second specified sub-pixel column and a third specified sub-pixel column adjacent to the first specified sub-pixel column in a direction along the row direction, (iii) to apply a voltage having a polarity different from the first specified sub-pixel column to the other signal line, and (iv) to invert the polarities of the voltages to be applied at predetermined cycles.

According to another aspect, a display device includes: an image display panel including a plurality of pixels including first sub-pixels, second sub-pixels, third sub-pixels, and fourth sub-pixels. The plurality of pixels includes therein, first sub-pixel columns including the first sub-pixels, second sub-pixel columns including the second sub-pixels arranged next to the respective first columns, and third sub-pixel columns arranged next to the respective second columns. The first sub-pixel column to the third sub-pixel column are periodically arranged. In each of the third sub-pixel columns, the third sub-pixel and the fourth sub-pixel are alternately arranged in a direction along the corresponding third sub-pixel column. One of the third sub-pixels and one of the fourth sub-pixels in each adjacent two of the third sub-pixel columns are alternately arranged in a direction along a row in the same row across the third sub-pixel columns. The display device also includes: signal lines provided to the first sub-pixel columns, the second sub-pixel columns, and the third sub-pixel columns; and a control device that controls the pixels based on image signals. The control device: (i) applies a voltage having the same polarity to the signal lines of adjacent two columns among the first sub-pixel columns to the third sub-pixel columns that are periodically arranged, (ii) applies a voltage having a different polarity to next two columns subsequent to the adjacent two columns, and (iii) inverts the polarities of the voltages to be applied at predetermined cycles.

DETAILED DESCRIPTION

The following describes a preferred embodiment in detail with reference to the drawings. The description will be provided in the following order.

Figure 1:
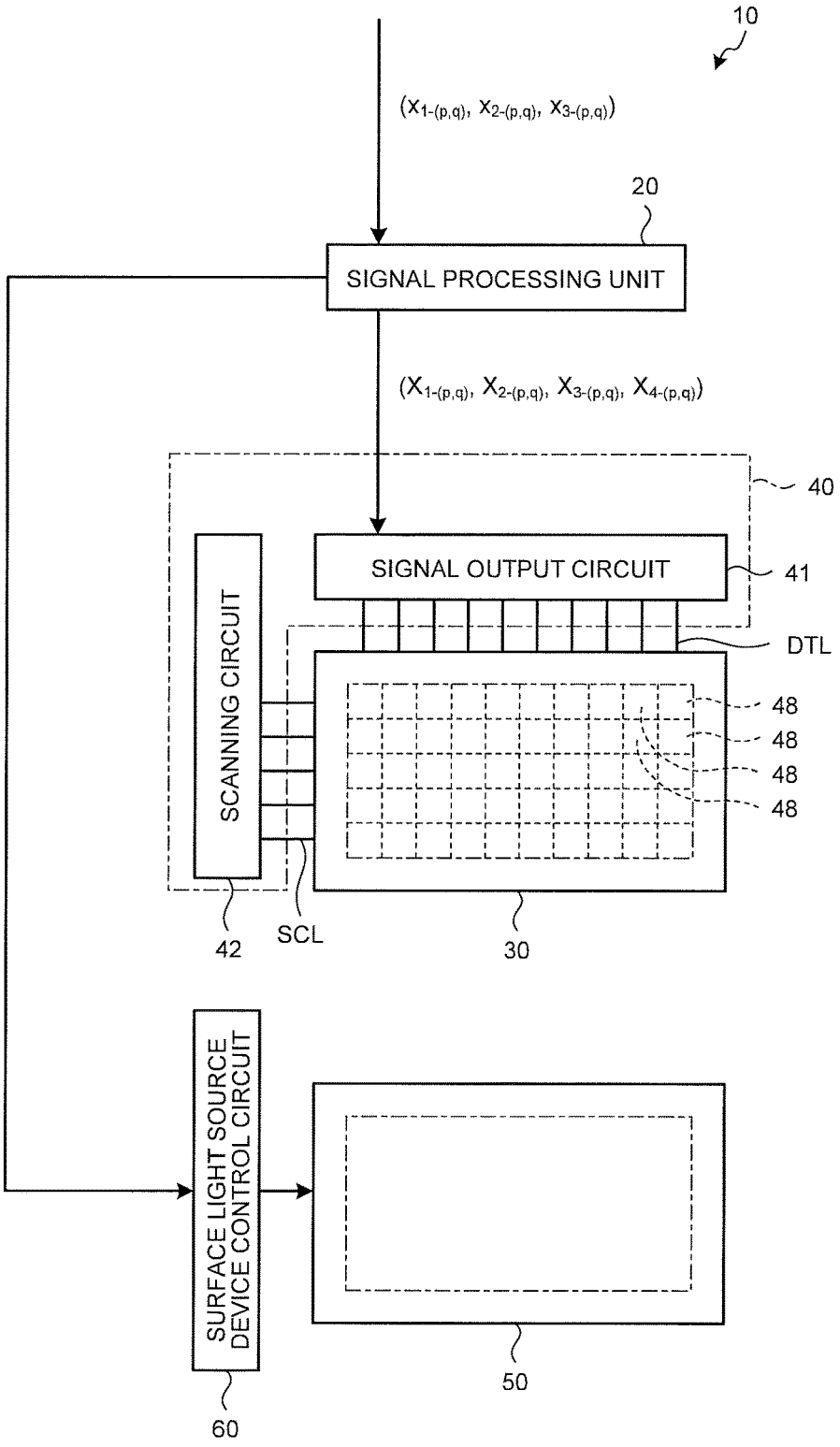
FIG. 1 is a block diagram illustrating an example of a configuration of a display device according to an embodiment.
Figure 2:
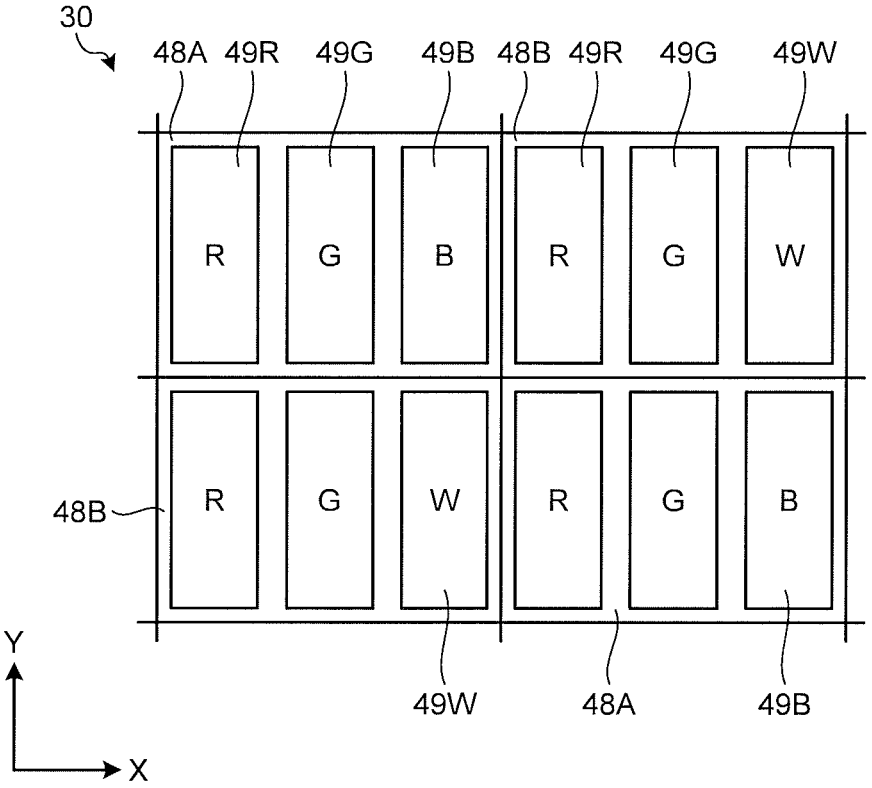
FIG. 2 is a diagram illustrating a pixel array of an image display panel according to the embodiment.
Figure 3:
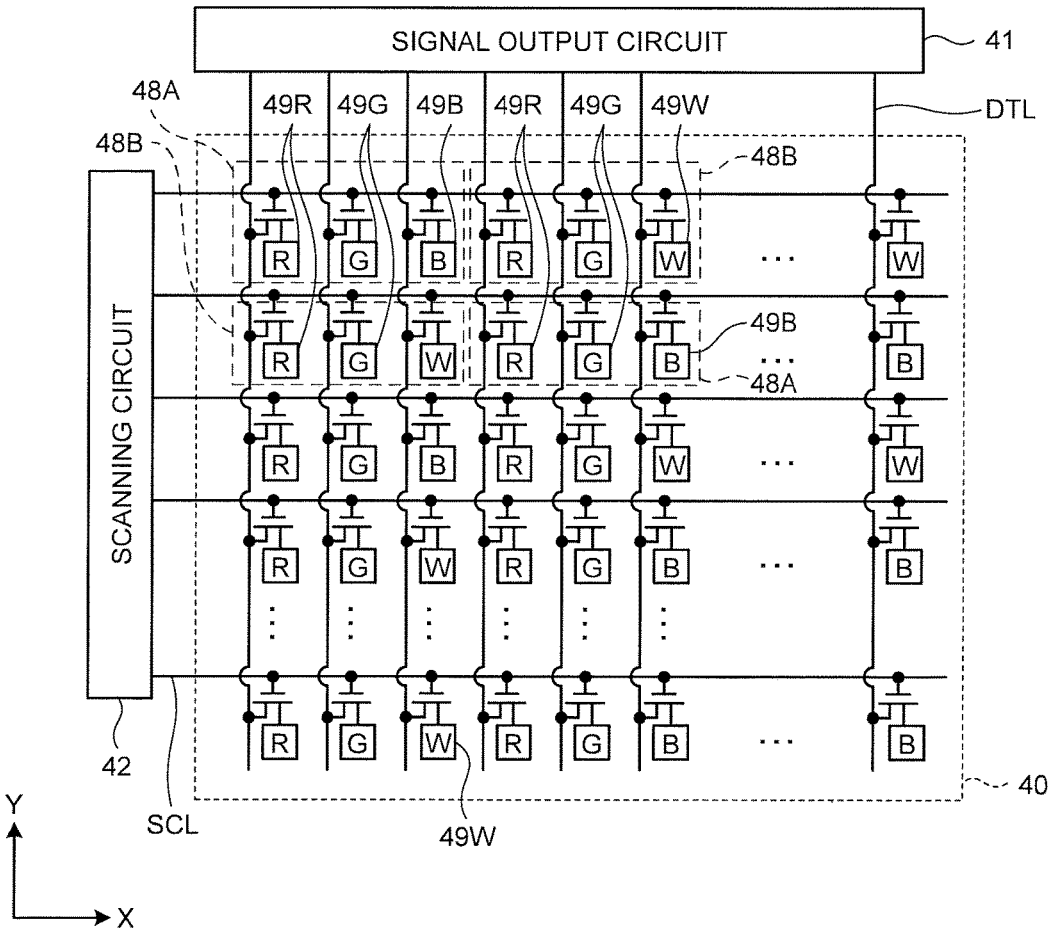
FIG. 3 is a conceptual diagram of the image display panel and an image display panel drive circuit of the display device according to the embodiment.

1. Configuration of Display Device
2. Processing Operations of Display Device
3. Modifications
4. Application Examples (Electronic Apparatuses)
5. Configuration of Present Disclosure 1. Configuration of Display Device FIG. 1 is a block diagram illustrating an example of a configuration of a display device according to the embodiment. FIG. 2 is a diagram illustrating a pixel array of an image display panel according to the embodiment. FIG. 3 is a conceptual diagram of the image display panel and an image display panel drive circuit of the display device according to the embodiment.

As illustrated in FIG. 1, a display device 10 includes a signal processing unit 20 that transmits a signal to each component of the display device 10 to control an operation thereof, an image display panel 30 that displays an image based on an output signal output from the signal processing unit 20, an image display panel drive circuit 40 that controls driving of the image display panel 30, a surface light source device 50 that illuminates the image display panel 30 from its back surface, and a surface light source device control circuit 60 that controls driving of the surface light source device 50. The display device 10 has the same configuration as that of an image display device assembly disclosed in JP-A-2011-154323, and various modifications described in JP-A-2011-154323 can be applied thereto.

The signal processing unit 20 is an arithmetic processing unit that controls operations of the image display panel 30 and the surface light source device 50. The signal processing unit 20 is coupled to the image display panel drive circuit 40 for driving the image display panel 30, and the surface light source device control circuit 60 for driving the surface light source device 50. The signal processing unit 20 processes the input signal input from the outside to generate the output signal and a surface light source device control signal. That is, the signal processing unit 20 converts an input value (input signal) of an input signal in an input HSV color space into an extended value (output signal) in an extended HSV color space extended with the first color, the second color, the third color, and the fourth color to be generated, and outputs the generated output signal to the image display panel 30. The signal processing unit 20 outputs the generated output signal to the image display panel drive circuit 40 and outputs the generated surface light source device control signal to the surface light source device control circuit 60.

As illustrated in FIGS. 2 and 3, the pixels 48 are arranged in a two-dimensional matrix of $P_0 \times Q_0$ ($P_0$ in a row direction, and $Q_0$ in a column direction) in the image display panel 30. FIGS. 2 and 3 illustrate an example in which the pixels 48 are arranged in a matrix on an XY two-dimensional coordinate system. In this example, the row direction is the X-direction and the column direction is the Y-direction.

Each of the pixels 48 includes a first sub-pixel 49R, a second sub-pixel 49G, a third sub-pixel 49B, and a fourth sub-pixel 49W. The first sub-pixel 49R displays a first primary color (for example, red). The second sub-pixel 49G displays a second primary color (for example, green). The third sub-pixel 49B displays a third primary color (for example, blue). The fourth sub-pixel 49W displays a fourth primary color (specifically, white). In the following description, the first sub-pixel 49R, the second sub-pixel 49G, the third sub-pixel 49B, and the fourth sub-pixel 49W may be collectively referred to as sub-pixels 49 when they are not required to be distinguished from each other.

More specifically, the display device 10 is a transmissive color liquid crystal display device. The image display panel 30 is a color liquid crystal display panel in which a first color filter that allows the first primary color to pass through is arranged between the first sub-pixel 49R and an image observer, a second color filter that allows the second primary color to pass through is arranged between the second sub-pixel 49G and the image observer, and a third color filter that allows the third primary color to pass through is arranged between the third sub-pixel 49B and the image observer. In the image display panel 30, there is no color filter between the fourth sub-pixel 49W and the image observer. A transparent resin layer may be provided for the fourth sub-pixel 49W instead of the color filter. In this way, in the image display panel 30, providing the transparent resin layer can suppress occurrence of a large level difference in the fourth sub-pixel 49W that would otherwise occur when no color filter is provided for the fourth sub-pixel 49W.

In the image display panel 30, pixels 48A and pixels 48B are arranged in a matrix, the pixels 48A and the pixels 48B each including a combination of sub-pixels including the first sub-pixel 49R, the second sub-pixel 49G, the third sub-pixel 49B, and the fourth sub-pixel 49W. As illustrated in FIGS. 2 and 3, in the image display panel 30, the pixel 48A including the first sub-pixel 49R, the second sub-pixel 49G, and the third sub-pixel 49B and the pixel 48B including the first sub-pixel 49R, the second sub-pixel 49G, and the fourth sub-pixel 49W are alternately arranged in the row direction and the column direction. In the image display panel 30, first sub-pixel columns, second sub-pixel columns next to the respective first sub-pixel columns, and third sub-pixel columns next to the respective second sub-pixel columns are repeatedly arranged. In each of the first sub-pixel columns, the first sub-pixels 49R are arranged. In each of the second sub-pixel columns, the second sub-pixels 49G are arranged. In each of the third sub-pixel columns, the third sub-pixel 49B and the fourth sub-pixel 49W are alternately arranged in a direction along the column direction of the third sub-pixel column. Across the third sub-pixel columns, the third sub-pixels 49B and the fourth sub-pixels 49W are alternately arranged in the same row across the third sub-pixel columns so that each adjacent two of the third sub pixel columns in the direction along the row direction may contain the third sub-pixel 49B and the fourth sub-pixel 49W. In the third sub-pixel columns, the luminance of the third sub-pixel 49B of blue, the human visibility of which is lower than that of the first sub-pixel 49R and the second sub-pixel 49G, can be compensated with the luminance of the fourth sub-pixel 49W. The third sub-pixel 49B and the fourth sub-pixel 49W in the same row across the third sub-pixel columns are coupled to the same scanning line SCL.

Generally, an arrangement similar to a stripe array is preferable for displaying data or character strings on a personal computer and the like. In contrast, an arrangement similar to a mosaic array is preferable for displaying a natural image on a video camera recorder, a digital still camera, or the like.

The image display panel drive circuit 40 is a control device according to the embodiment, and includes a signal output circuit 41 and a scanning circuit 42. In the image display panel drive circuit 40, the signal output circuit 41 holds video signals to be sequentially output to the image display panel 30. The signal output circuit 41 is electrically coupled to the image display panel 30 via a signal line DTL. In the image display panel drive circuit 40, the scanning circuit 42 selects a sub-pixel in the image display panel 30, and controls ON and OFF of a switching element (for example, a thin film transistor (TFT)) for controlling an operation of the sub-pixel (light transmittance). The scanning circuit 42 is electrically coupled to the image display panel 30 via the scanning line SCL.

The surface light source device 50 is arranged on a back surface of the image display panel 30, and illuminates the image display panel 30 by irradiating the image display panel 30 with light. The surface light source device 50 irradiates the entire surface of the image display panel 30 with light to illuminate the image display panel 30. The surface light source device control circuit 60 controls light quantity and the like of the light output from the surface light source device 50. Specifically, the surface light source device control circuit 60 adjusts a duty ratio or a voltage to be supplied to the surface light source device 50 based on the surface light source device control signal output from the signal processing unit 20 to control the light quantity (light intensity) of the light with which the image display panel 30 is irradiated. Next, the following describes a processing operation executed by the display device 10, more specifically, the signal processing unit 20.

2. Processing Operations of Display Device

Figure 4:
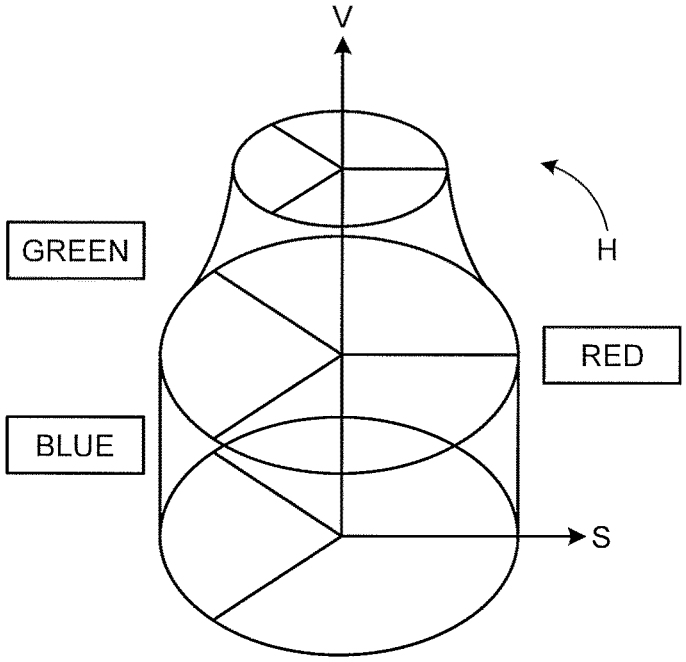
FIG. 4 is a conceptual diagram of an extended HSV color space that can be extended by the display device according to the embodiment.
Figure 5:
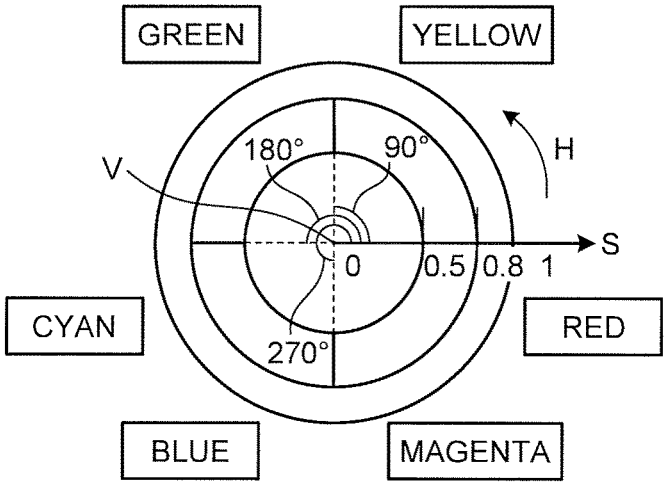
FIG. 5 is a conceptual diagram illustrating a relation between a hue and saturation in the extended HSV color space.

FIG. 4 is a conceptual diagram of the extended HSV color space that can be extended by the display device according to the embodiment. FIG. 5 is a conceptual diagram illustrating a relation between a hue and saturation in the extended HSV color space. The signal processing unit 20 receives an input signal that is information of an image to be displayed input from the outside. The input signal includes the information of the image (colors) to be displayed at its position for each pixel as the input signal. Specifically, in the image display panel 30 in which $P_0 \times Q_0$ pixels 48 are arranged in a matrix, with respect to the (p, q)-th pixel 48 (where $1 \leq p \leq P_0$, $1 \leq q \leq Q_0$), the signal processing unit 20 receives a signal including an input signal of the first sub-pixel 49R the signal value of which is $x_{1-(p,\ q)}$, an input signal of the second sub-pixel 49G the signal value of which is $x_{2-(p,\ q)}$, and an input signal of the third sub-pixel 49B the signal value of which is $x_{3-(p,\ q)}$ (refer to FIG. 1).

The signal processing unit 20 illustrated in FIG. 1 processes the input signal to generate an output signal of the first sub-pixel for determining display gradation of the first sub-pixel 49R (signal value $X_{1-(p,\ q)}$, an output signal of the second sub-pixel for determining the display gradation of the second sub-pixel 49G (signal value $X_{2-(p,\ q)}$), an output signal of the third sub-pixel for determining the display gradation of the third sub-pixel 49B (signal value $X_{3-(p,\ q)}$), and an output signal of the fourth sub-pixel for determining the display gradation of the fourth sub-pixel 49W (signal value $X_{4-(p,\ q)}$) to be output to the image display panel drive circuit 40.

In the display device 10, the pixel 48 includes the fourth sub-pixel 49W for outputting the fourth color (white) to widen a dynamic range of the brightness in the HSV color space (extended HSV color space) as illustrated in FIG. 4. That is, as illustrated in FIG. 4, a substantially trapezoidal three-dimensional shape, in which the maximum value of the brightness V is reduced as the saturation S increases, is additionally placed on a cylindrical HSV color space that can be displayed by the first sub-pixel 49R, the second sub-pixel 49G, and the third sub-pixel 49B.

The signal processing unit 20 stores the maximum value Vmax(S) of the brightness using the saturation S as a variable in the HSV color space expanded by adding the fourth color (white). That is, the signal processing unit 20 stores the maximum value Vmax(S) of the brightness for respective sets of coordinates (values) of the saturation and the hue regarding the three-dimensional shape of the HSV color space illustrated in FIG. 4. The input signals include the input signals for the first sub-pixel 49R, the second sub-pixel 49G, and the third sub-pixel 49B, so that the HSV color space of the input signals has a cylindrical shape, that is, the same shape as a cylindrical part of the extended HSV color space.

Next, the signal processing unit 20 calculates the output signal (signal value $X_{4-(p,\ q)}$) of the fourth sub-pixel 49W based on the input signal (signal value $x_{1-(p,\ q)}$) of the first sub-pixel 49R, the input signal (signal value $x_{2-(p,\ q)}$) of the second sub-pixel 49G, the input signal (signal value $x_{3-(p,\ q)}$) and the signal expansion coefficient $\alpha$ of, and outputs the output signal to the fourth sub-pixel 49W.

The signal processing unit 20 also calculates the output signal (signal value $X_{1-(p,\ q)}$) of the first sub-pixel 49R based on at least the input signal (signal value $x_{1-(p,\ q)}$) and the expansion coefficient $\alpha$ of the first sub-pixel 49R, and the output signal (signal value $X_{4-(p,\ q)}$) of the fourth sub-pixel 49W, and outputs the output signal to the first sub-pixel 49R.

The signal processing unit 20 also calculates the output signal (signal value $X_{2-(p,\ q)}$) of the second sub-pixel 49G based on at least the input signal (signal value $x_{2-(p,\ q)}$) and an expansion coefficient $\alpha$ of the second sub-pixel 49G, and the output signal (signal value $X_{4-(p,\ q)}$) of the fourth sub-pixel 49W, and outputs the output signal to the second sub-pixel 49G.

The signal processing unit 20 also calculates the output signal (signal value $X_{3-(p,\ q)}$) of the third sub-pixel 49B based on at least the input signal (signal value $x_{3-(p,\ q)}$) and the expansion coefficient $\alpha$ of the third sub-pixel 49B, and the output signal (signal value $X_{4-(p,\ q)}$) of the fourth sub-pixel 49W, and outputs the output signal to the third sub-pixel 49B.

Specifically, the signal processing unit 20 calculates the output signal of the first sub-pixel 49R based on the expansion coefficient $\alpha$ of the first sub-pixel 49R and the output signal of the fourth sub-pixel 49W, calculates the output signal of the second sub-pixel 49G based on the expansion coefficient $\alpha$ of the second sub-pixel 49G and the output signal of the fourth sub-pixel 49W, and calculates the output signal of the third sub-pixel 49B based on the expansion coefficient $\alpha$ of the third sub-pixel 49B and the output signal of the fourth sub-pixel 49W.

That is, assuming that $\chi$ is a constant depending on the display device, the signal processing unit 20 obtains, from the following expressions (1) to (3), the signal value $X_{1-(p,\ q)}$ as the output signal of the first sub-pixel 49R, the signal value $X_{2-(p,\ q)}$ as the output signal of the second sub-pixel 49G, and the signal value $X_{3-(p,\ q)}$ as the output signal of the third sub-pixel 49B, each of the signal values being output to the (p, q)-th pixel (or a group of the first sub-pixel 49R, the second sub-pixel 49G, and the third sub-pixel 49B).

$$X_{1-(p,\ q)} = \alpha \cdot x_{1-(p,\ q)} - \chi \cdot X_{4-(p,\ q)} \tag{1}$$

$$X_{2-(p,\ q)} = \alpha \cdot x_{2-(p,\ q)} - \chi \cdot X_{4-(p,\ q)} \tag{2}$$

$$X_{3-(p,\ q)} = \alpha \cdot x_{3-(p,\ q)} - \chi \cdot X_{4-(p,\ q)} \tag{3}$$

The signal processing unit 20 obtains the maximum value Vmax(S) of the brightness using the saturation S as a variable in the HSV color space expanded by adding the fourth color, and obtains the saturation S and the brightness V(S) in the pixels 48 based on the input signal values of the sub-pixels 49 in the pixels 48.

The saturation S and the brightness V(S) are expressed as S=(Max−Min)/Max and V(S)=Max. The saturation S may take values of 0 to 1 and the brightness V(S) may take values of 0 to $(2^n-1)$. n is a display gradation bit number. Max is the maximum value among the input signal value of the first sub-pixel 49R, the input signal value of the second sub-pixel 49G, and the input signal value of the third sub-pixel 49B that are input to the pixel 48. Min is the minimum value among the input signal value of the first sub-pixel 49R, the input signal value of the second sub-pixel 49G, and the input signal value of the third sub-pixel 49B that are input to the pixel 48. A hue H is represented in a range of 0° to 360° as illustrated in FIG. 5. Arranged are red, yellow, green, cyan, blue, magenta, and red from 0° to 360°.

According to the embodiment, the signal value $X_{4-(p,\ q)}$ can be obtained based on a product of $Min_{(p,\ q)}$ and the expansion coefficient $\alpha$. Specifically, the signal value $X_{4-(p,\ q)}$ can be obtained based on the following expression (4). In the expression (4), the product of $Min_{(p, q)}$ and the expansion coefficient $\alpha$ is divided by $\chi$. However, the embodiment is not limited thereto. $\chi$ is to be described later. The expansion coefficient $\alpha$ is determined for each image display frame.

$$X_{4-(p, q)}=Min_{(p, q)}\cdot\alpha/\chi \quad (4)$$

Generally, in the (p, q)-th pixel, the saturation $S_{(p, q)}$ and the brightness $V(S)_{(p, q)}$ in the cylindrical HSV color space can be obtained from the following expressions (5) and (6) based on the input signal (signal value $x_{1-(p, q)}$) of the first sub-pixel 49R, the input signal (signal value $x_{2-(p, q)}$) of the second sub-pixel 49G, and the input signal (signal value $x_{3-(p, q)}$) of the third sub-pixel 49B.

$$S_{(p, q)}=(Max_{(p, q)}-Min_{(p, q)})/Max_{(p, q)} \quad (5)$$

$$V(S)_{(p, q)}=Max_{(p, q)} \quad (6)$$

In the above expressions, $Max_{(p, q)}$ represents the maximum value among the input signal values of three sub-pixels 49 ($x_{1-(p, q)}$, $x_{2-(p, q)}$, and $x_{3-(p, q)}$), and $Min_{(p, q)}$ represents the minimum value among the input signal values of three sub-pixels 49 ($x_{1-(p, q)}$, $x_{2-(p, q)}$, and $x_{3-(p, q)}$). In the embodiment, n is assumed to be 8. That is, the display gradation bit number is assumed to be 8 bits (a value of the display gradation is assumed to correspond to any one of 256 gradations, that is, 0 to 255).

No color filter is arranged for the fourth sub-pixel 49W that displays white. When a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is assumed to be $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is assumed to be $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Assuming that $\chi$ is a constant depending on the display device, the constant $\chi$ is represented by $\chi=BN_4/BN_{1-3}$.

Specifically, for example, on the assumption that the input signal having a value 255 of display gradation is input to the fourth sub-pixel 49W, the luminance $BN_4$ is 1.5 times the luminance $BN_{1-3}$ of white when the input signals having the following values of display gradation, the signal value $x_{1-(p, q)}=255$, the signal value $x_{2-(p, q)}=255$, and the signal value $x_{3-(p, q)}=255$, are input to the aggregate of the first sub-pixel 49R, the second sub-pixel 49G, and the third sub-pixel 49B. That is, in this embodiment, $\chi$ is assumed to be 1.5.

When the signal value $X_{4-(p, q)}$ is represented by the expression (4) described above, Vmax(S) can be represented by the following expressions (7) and (8).

When $S\leq S_0$, $$Vmax(S)=(\chi+1)\cdot(2^n-1), \quad (7)$$

and, when $S_0<S\leq 1$, $$Vmax(S)=(2^n-1)\cdot(1/S), \quad (8)$$

where $S_0=1/(\chi+1)$.

The thus obtained maximum value Vmax(S) of the brightness using the saturation S as a variable in the HSV color space expanded by adding the fourth color is stored in the signal processing unit 20 as a kind of look-up table, for example. Alternatively, the signal processing unit 20 obtains the maximum value Vmax(S) of the brightness using the saturation S as a variable in the expanded HSV color space as occasion demands.

Next, the following describes a method of obtaining the signal values $X_{1-(p, q)}$, $X_{2-(p, q)}$, $X_{3-(p, q)}$, and $X_{4-(p, q)}$ as output signals of the (p, q)-th pixel 48 (expansion processing). The following processing is performed to keep a ratio among the luminance of a first primary color displayed by (first sub-pixel 49R+fourth sub-pixel 49W), the luminance of a second primary color displayed by (second sub-pixel 49G+fourth sub-pixel 49W), and the luminance of a third primary color displayed by (third sub-pixel 49B+fourth sub-pixel 49W) with respect to the input R, G, and B luminances. The processing is performed also to keep (maintain) color tone. In addition, the processing is performed to keep (maintain) a gradation-luminance characteristic (gamma characteristic, $\gamma$ characteristic). When all of the input signal values are 0 or small values in any one of the pixels 48 or a group of the pixels 48, the expansion coefficient $\alpha$ may be obtained without including such pixel 48 or a group of pixels 48.

First Process

First, the signal processing unit 20 obtains the saturation S and the brightness V(S) in the pixels 48 based on the input signal values of the sub-pixels 49 of the pixels 48. Specifically, $S_{(p, q)}$ and $V(S)_{(p, q)}$ are obtained from the expressions (5) and (6) based on the signal value $x_{1-(p, q)}$ that is the input signal of the first sub-pixel 49R, the signal value $x_{2-(p, q)}$ that is the input signal of the second sub-pixel 49G, and the signal value $x_{3-(p, q)}$ that is the input signal of the third sub-pixel 49B, each of the signal values being input to the (p, q)-th pixel 48. The signal processing unit 20 performs this processing on all of the pixels 48.

Second Process

Next, the signal processing unit 20 obtains the expansion coefficient $\alpha(S)$ based on the Vmax(S)/V(S) obtained in the pixels 48. The $\alpha$ is a $\alpha$ having the smallest value among a plurality of $\alpha(S)$ for a frame.

$$\alpha(S)=Vmax(S)/V(S) \quad (9)$$

Third Process

Next, the signal processing unit 20 obtains the signal value $X_{4-(p, q)}$ of the (p, q)-th pixel 48 based on at least the signal value $x_{1-(p, q)}$, the signal value $x_{2-(p, q)}$, the signal value $x_{3-(p, q)}$, and $\alpha$. In the embodiment, the signal processing unit 20 determines the signal value $X_{4-(p, q)}$ based on $Min_{(p, q)}$, the expansion coefficient $\alpha$, and the constant $\chi$. More specifically, as described above, the signal processing unit 20 obtains the signal value $X_{4-(p, q)}$ based on the expression (4). The signal processing unit 20 obtains the signal value $X_{4-(p, q)}$ for all of the $P_0\times Q_0$ pixels 48.

Fourth Process

Subsequently, the signal processing unit 20 obtains the signal value $X_{1-(p, q)}$ in the (p, q)-th pixel 48 based on the signal value $x_{1-(p, q)}$, the expansion coefficient $\alpha$, and the signal value $X_{4-(p, q)}$, obtains the signal value $X_{2-(p, q)}$ in the (p, q)-th pixel 48 based on the signal value $x_{2-(p, q)}$, the expansion coefficient $\alpha$, and the signal value $X_{4-(p, q)}$, and obtains the signal value $X_{3-(p, q)}$ in the (p, q)-th pixel 48 based on the signal value $x_{3-(p, q)}$, the expansion coefficient $\alpha$, and the signal value $X_{4-(p, q)}$. Specifically, the signal processing unit 20 obtains the signal value $X_{1-(p, q)}$, the signal value $X_{2-(p,q)}$, and the signal value $X_{3-(p,q)}$ in the (p, q)-th pixel 48 based on the expressions (1) to (3) described above.

The signal processing unit 20 expands the input signal value with α as represented by the expressions (1), (2), (3), and (4). As the input signal value is expanded with α, the luminance is increased. In this case, a luminance ratio among the expanded R, G, and B is kept with respect to the luminance ratio among the input R, G, and B, so that dullness of color can be prevented. The luminance of the entire image is multiplied by α. Accordingly, for example, a static image and the like can be preferably displayed with high luminance.

The signal value $X_{1-(p,q)}$, the signal value $X_{2-(p,q)}$, the signal value $X_{3-(p,q)}$, and the signal value $X_{4-(p,q)}$ in the (p, q)-th pixel 48 are expanded by α times. Accordingly, in the display device 10, the luminance of the surface light source device 50 may be reduced based on the expansion coefficient α in order that the luminance of an image may be the same as the luminance of the image that is not expanded. Specifically, the luminance of the surface light source device 50 may be multiplied by (1/α). The signal processing unit 20 calculates selector signals SELR, SELG, and SELB (SELW) described later to output the signal value $X_{1-(p,q)}$, the signal value $X_{2-(p,q)}$, the signal value $X_{3-(p,q)}$, and the signal value $X_{4-(p,q)}$ in in the (p, q)-th pixel 48.

Example of Liquid Crystal Display Device of Lateral Electric-Field Mode

Figure 6:
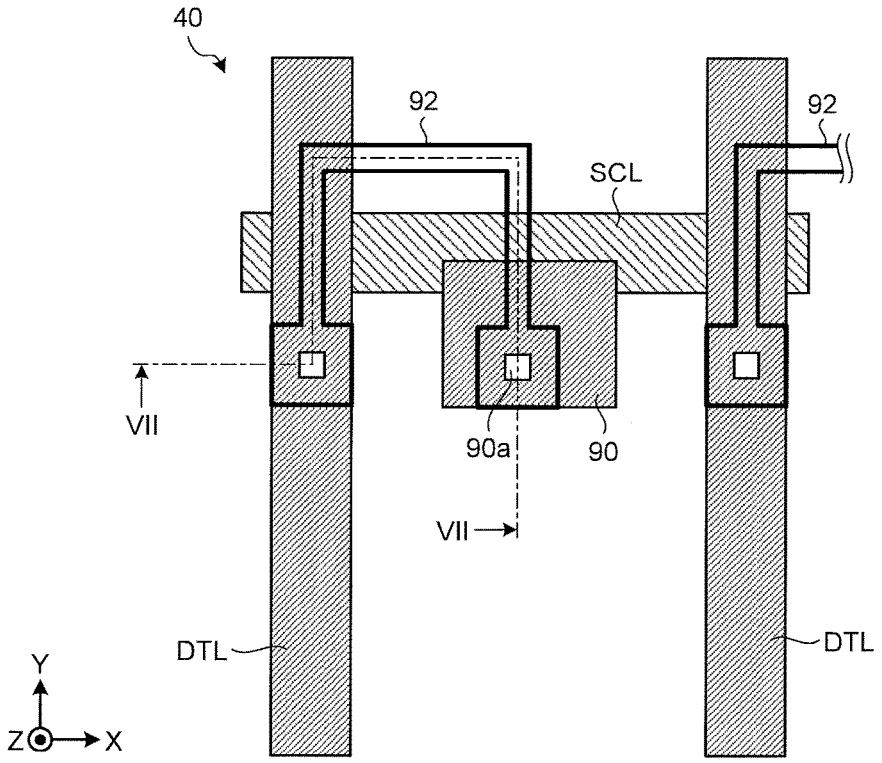
FIG. 6 is a schematic diagram for explaining a circuit pattern of the image display panel according to the embodiment.
Figure 7:
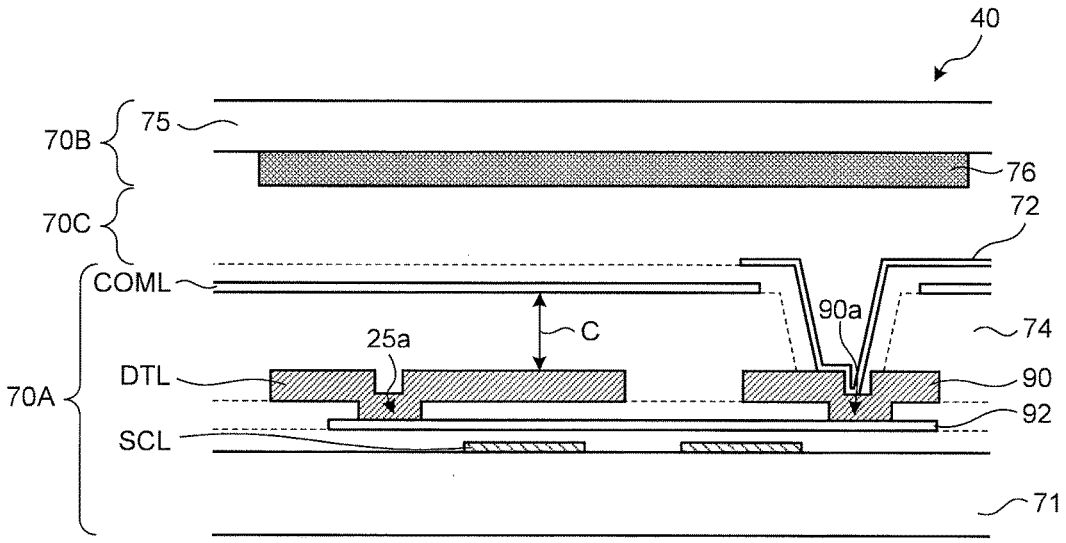
FIG. 7 is a cross-sectional view along the line VII-VII in FIG. 6.

FIG. 6 is a schematic diagram for explaining a circuit pattern of the image display panel according to the embodiment. FIG. 7 is a cross-sectional view along the line VII-VII in FIG. 6. As illustrated in FIG. 7, the image display panel 30 includes a pixel substrate 70A, a counter substrate 70B arranged so as to be opposed to the pixel substrate 70A in a direction perpendicular to a surface of the pixel substrate 70A, and a liquid crystal layer 70C interposed between the pixel substrate 70A and the counter substrate 70B. The surface light source device 50 (refer to FIG. 1) described above is arranged as a backlight on a surface of the pixel substrate 70A opposite from the liquid crystal layer 70C.

The liquid crystal layer 70C modulates light passing therethrough in accordance with the state of an electric field. Used herein is a liquid crystal display device utilizing, as the liquid crystal layer 70C, liquid crystal of a lateral electric-field mode such as the fringe field switching (FFS) mode or the in-plane switching (IPS) mode. The liquid crystal layer 70C may be liquid crystal of any one of various modes such as twisted nematic (TN), vertical alignment (VA), and electrically controlled birefringence (ECB). Orientation films may be arranged between the liquid crystal layer 70C and the pixel substrate 70A illustrated in FIG. 7, and between the liquid crystal layer 70C and the counter substrate 70B illustrated therein, respectively.

The counter substrate 70B includes a translucent substrate 75 and a color filter 76 formed on one side of the translucent substrate 75. The color filter 76 includes, for example, color regions colored in four colors of red (R), green (G), blue (B), and white (W). In the color filter 76, the color regions colored in four colors of red (R), green (G), blue (B), and white (W) are periodically arranged around an opening (not illustrated), for example. The color filter 76 is opposed to the liquid crystal layer 70C in a direction perpendicular to a TFT substrate 71. The color filter 76 may include a combination of other colors so long as it is colored in different colors. Generally, in the color filter 76, the luminance of the color region of green (G) is higher than the luminance of the color region of red (R) and the color region of blue (B). A black matrix may be formed to cover the outer circumferences of the pixels. The black matrix is arranged at boundaries between the two-dimensionally arranged sub-pixels into a grid pattern. The black matrix is formed of a material having a high light absorption rate. A glass substrate is used as the translucent substrate 75 in the embodiment, but the embodiment is not limited thereto. A plastic substrate and the like may be used as the translucent substrate 75 instead of the glass substrate.

The pixel substrate 70A includes the TFT substrate 71 serving as a circuit board, a plurality of pixel electrodes 72 arranged in a matrix on the TFT substrate 71, a common electrode COML formed between the TFT substrate 71 and the pixel electrode 72, and an insulating layer 74 that insulates the pixel electrodes 72 from the common electrode COML. The common electrode COML is a translucent electrode formed of a translucent conductive material (translucent conductive oxide) such as indium tin oxide (ITO). The ITO is exemplified as the translucent conductive material in the embodiment, but the embodiment is not limited thereto. As the translucent conductive material, a conductive material having other composition such as indium zinc oxide (IZO) may be used.

On the TFT substrate 71, a semiconductor layer 92 in which thin film transistors Tr for the respective sub-pixels described above is formed, and wiring such as the signal lines DTL that supply a pixel signal to each pixel electrode 72 and the scanning lines SCL that drive the thin film transistors Tr are stacked via the insulating layer 74. Accordingly, the signal lines DTL and coupling capacitances C affect the common electrode COML. The TFT is used as a switching element for the pixel electrode 72 in the embodiment, but the embodiment is not limited thereto. As the switching element for the pixel electrode 72, an element such as a thin film diode may be used instead of the TFT.

Each of the signal lines DTL extends on a plane parallel to the surface of the TFT substrate 71, and supplies the pixel signal for displaying an image to the pixel. A part of the semiconductor layer 92 is in contact with the signal line DTL, and another part thereof is in contact with base wiring 90 formed in the same layer as the signal line DTL. In the present disclosure, the scanning lines SCL are first metal wiring that is wiring made of metal such as aluminum, the signal lines DTL are second metal wiring that is wiring made of metal such as aluminum, and the base wiring 90 is third metal wiring that is wiring made of metal such as aluminum. The insulating layer 74 performs insulation except a portion where the scanning line SCL is in contact with the semiconductor layer 92, or a contact part 25*a* and a contact part 90*a* (contact hole) being a portion where the signal line DTL is in contact with the semiconductor layer 92.

The semiconductor layer 92, each of the signal lines DTL, and each of the scanning lines SCL are formed in different layers in a direction perpendicular to the surface of the TFT substrate 71 (Z-direction). The signal lines DTL and the base wiring 90 are formed in the same layer in the direction perpendicular to the TFT substrate 71 (Z-direction).

The contact part 25*a* of each of the signal lines DTL is coupled to one of a source electrode and a drain electrode of the corresponding thin film transistor Tr in the semiconductor layer 92. The semiconductor layer 92 is coupled to the corresponding pixel electrode 72 via the base wiring 90. The corresponding contact part 90*a* of the base wiring 90 is coupled to the other one of the source electrode and the drain electrode of the thin film transistor Tr in the semiconductor layer 92. As illustrated in FIG. 3, the scanning line SCL is coupled to a gate of the thin film transistor Tr in the semiconductor layer 92.

As described above, each of the scanning lines SCL and each of the signal lines DTL are linear metal wiring, and arranged to substantially orthogonally intersect each other with one passing over the other. As illustrated in FIG. 6, the base wiring 90 is arranged, in the Z-direction, on an edge of a region surrounded by a first direction (X-direction) along the scanning line SCL and a second direction (Y-direction) along the signal line DTL.

In the image display panel 30 according to the embodiment illustrated in FIG. 6, the TFT substrate 71, the scanning lines SCL, the semiconductor layer 92, the signal lines DTL, the common electrode COML, and the pixel electrodes 72 are stacked in this order in the Z-direction. The image display panel 30 according to the embodiment has a bottom gate structure in which the semiconductor layer 92 is arranged on a plane between the scanning line SCL and the signal line DTL in the Z-direction. The thin film transistor Tr according to the embodiment has the bottom gate structure in which the scanning line SCL coupled to the gate of the thin film transistor Tr is arranged below the semiconductor layer 92, but the structure of the thin film transistor Tr is not limited thereto. The thin film transistor Tr may have a top gate structure in which a gate and a scanning line SCL electrically coupled to the gate are arranged above the semiconductor layer 92.

Column Inversion Driving Method

Examples of known driving methods for the liquid crystal display panel include a column inversion driving method, a line inversion driving method, a dot inversion driving method, and a frame inversion driving method. The column inversion driving method is a driving method for applying voltages the polarities of which are opposite to each other to lines (columns) each being composed of sub-pixels or pixels including combined sub-pixels, and inverting the polarities of the voltages to be applied at predetermined cycles. Accordingly, it is known that charge and discharge amounts are small in the signal line and low power consumption is achieved in the column inversion driving method as compared with the dot inversion driving method. Various circuits described in Japanese Examined Patent Application Publication No. H5-43118 can be applied to the signal processing unit 20.

Figure 8:
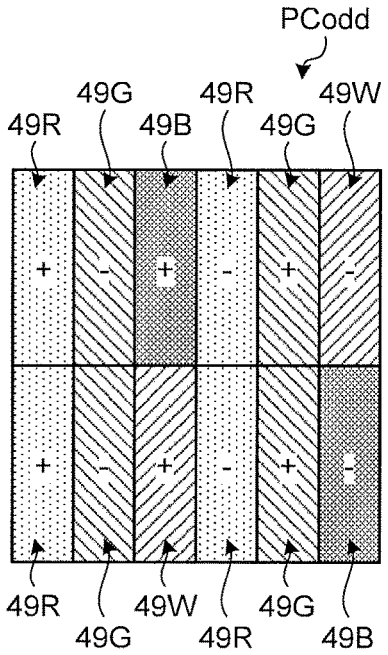
FIG. 8 is a schematic diagram for explaining a display region on which column inversion driving is performed.
Figure 9:
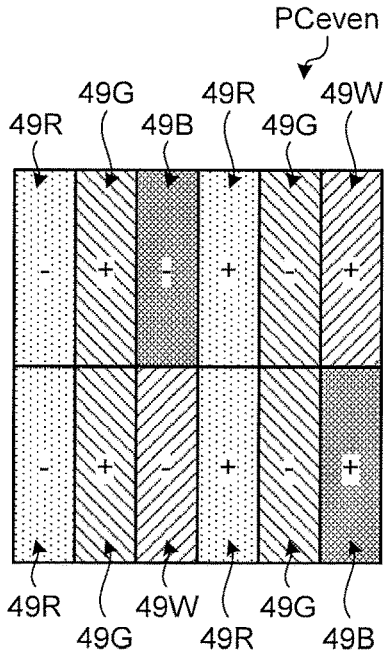
FIG. 9 is a schematic diagram for explaining the display region on which the column inversion driving is performed.
Figure 10:
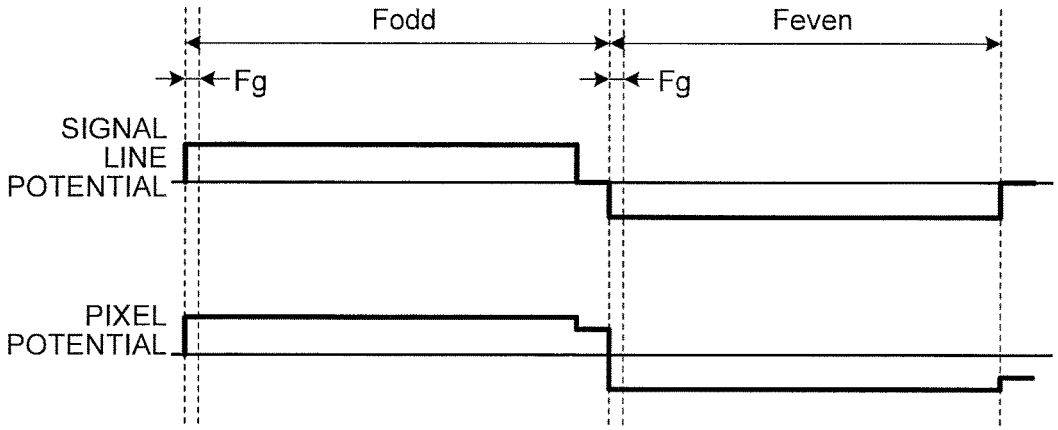
FIG. 10 is a schematic diagram for explaining a relation between a signal line potential and a pixel potential when the column inversion driving is performed.

FIGS. 8 and 9 are schematic diagrams for explaining a display region on which the column inversion driving is performed. FIG. 10 is a schematic diagram for explaining a relation between a signal line potential and a pixel potential when the column inversion driving is performed. For example, for each pixel in the row direction corresponding to the first sub-pixel 49R, the second sub-pixel 49G, and the third sub-pixel 49B (fourth sub-pixel 49W), an application state PCodd illustrated in FIG. 8 and an application state PCeven illustrated in FIG. 9 are alternately repeated with a potential (hereinafter, referred to as a plus (+) polarity (positive polarity)) higher than a reference potential and another potential (hereinafter, referred to as a minus (−) polarity (negative polarity)) lower than the reference potential, the reference potential being set to, for example, the potential of the common electrode. In the embodiment, the reference potential is set to the potential of the common electrode. However, the reference potential is not limited to the potential of the common electrode, and may be a predetermined potential. In this way, in the column inversion, the voltages are applied so that one line (column) and another line adjacent thereto among lines each composed of sub-pixels 49 are different in potential relative to the reference potential, and the polarities of the voltages to be applied are inverted at predetermined cycles. Accordingly, different voltages (for example, opposite polarities) are applied to adjacent signal lines, and the polarities of the voltages to be applied are inverted at predetermined cycles.

Figure 11:
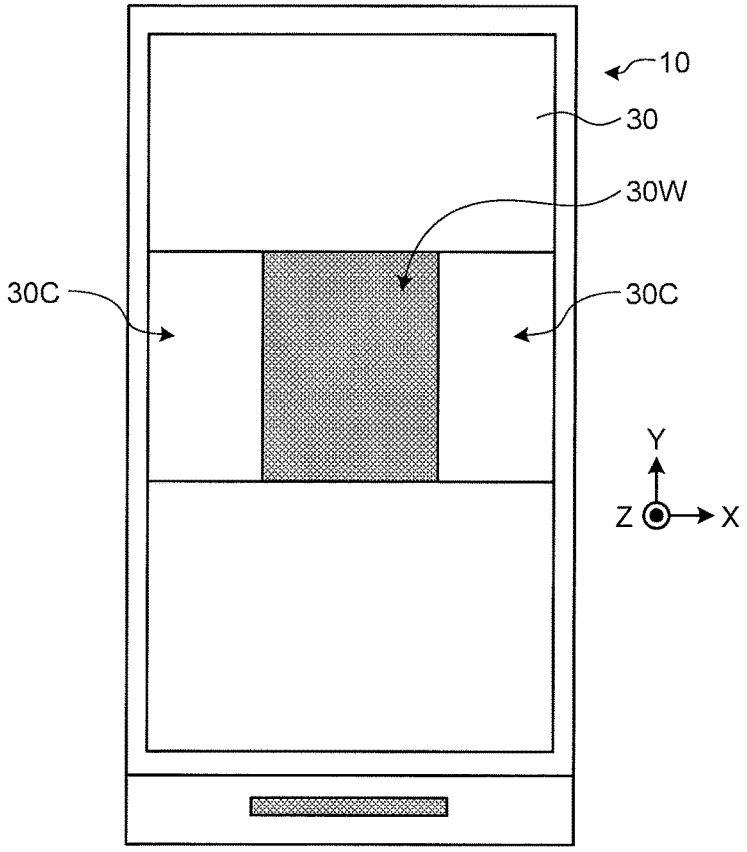
FIG. 11 is a schematic diagram for explaining crosstalk generated in an image display panel according to a comparative example.
Figure 12:
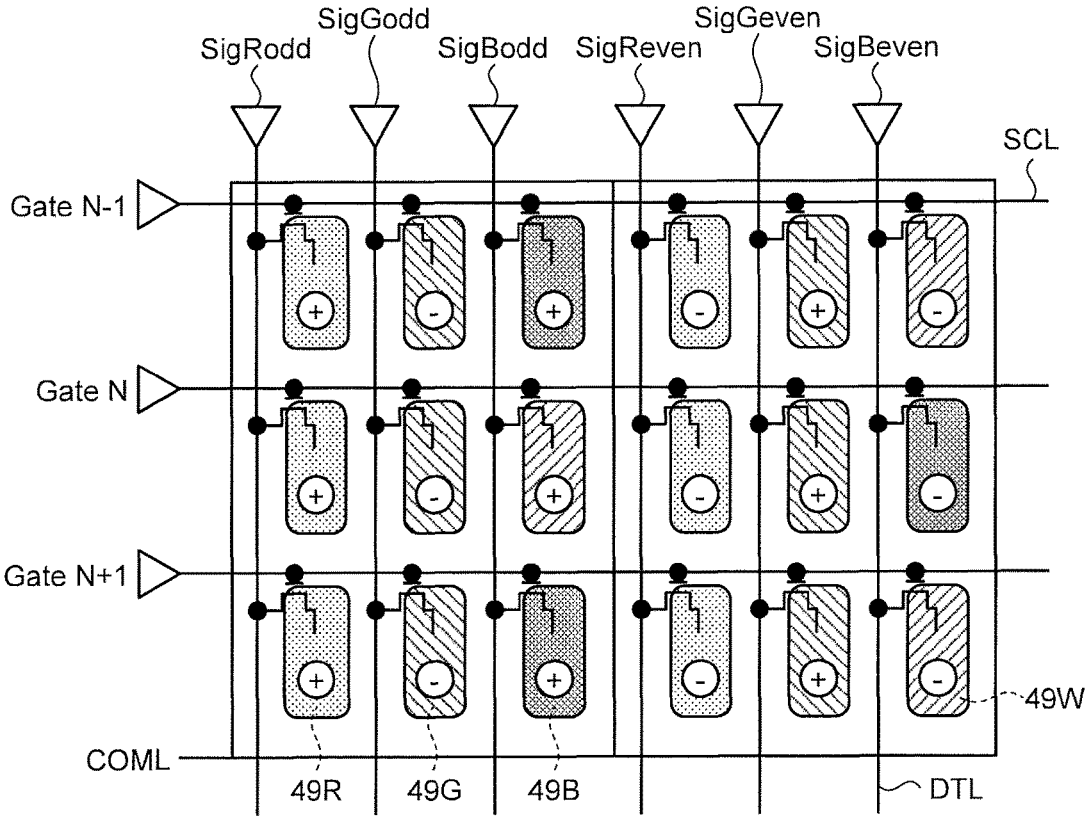
FIG. 12 is a schematic diagram illustrating a pixel array of the image display panel according to the comparative example.
Figure 13:
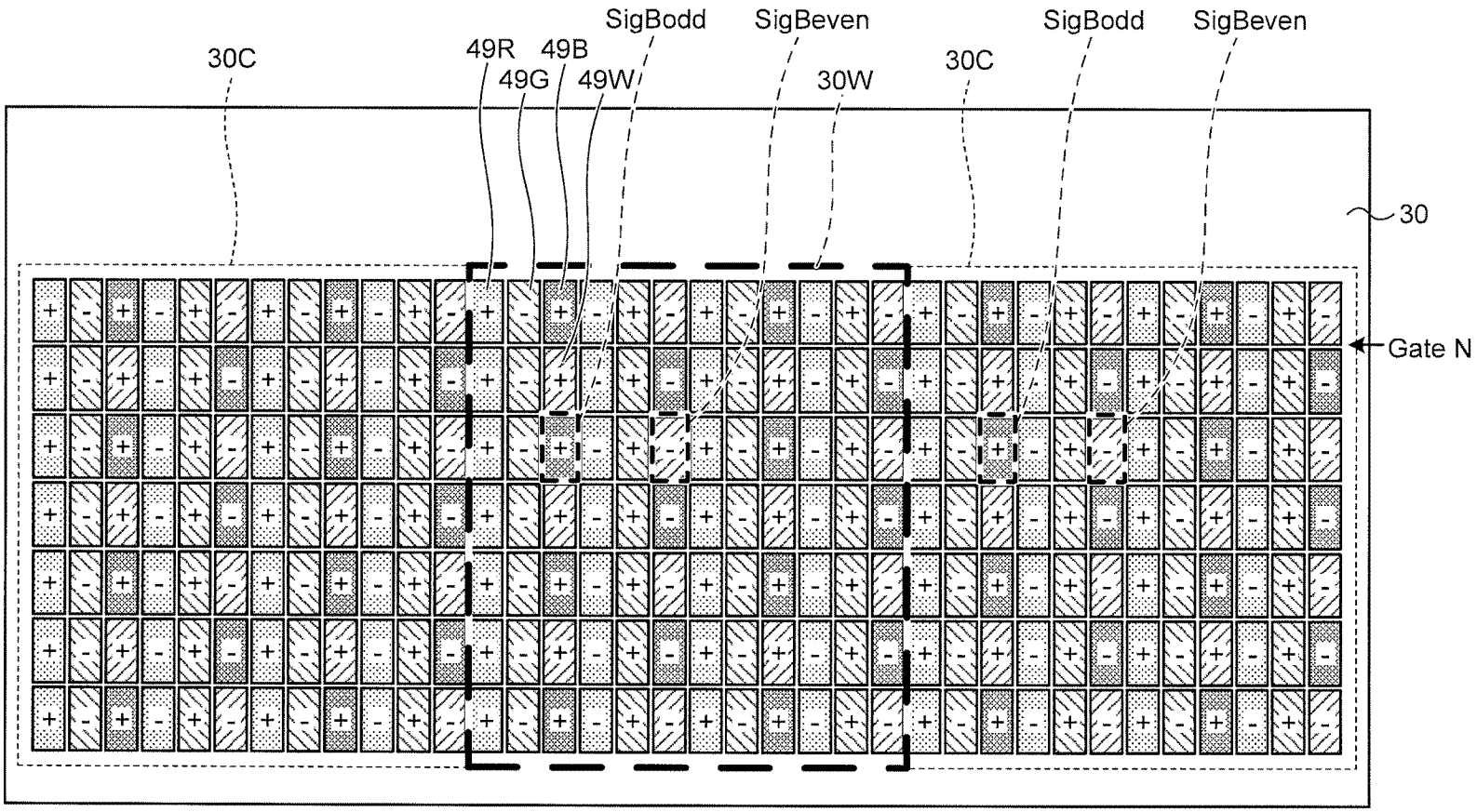
FIG. 13 is a schematic diagram for explaining states of sub-pixels when monochromatic display is performed at the center of the image display panel according to the comparative example.
Figure 14:
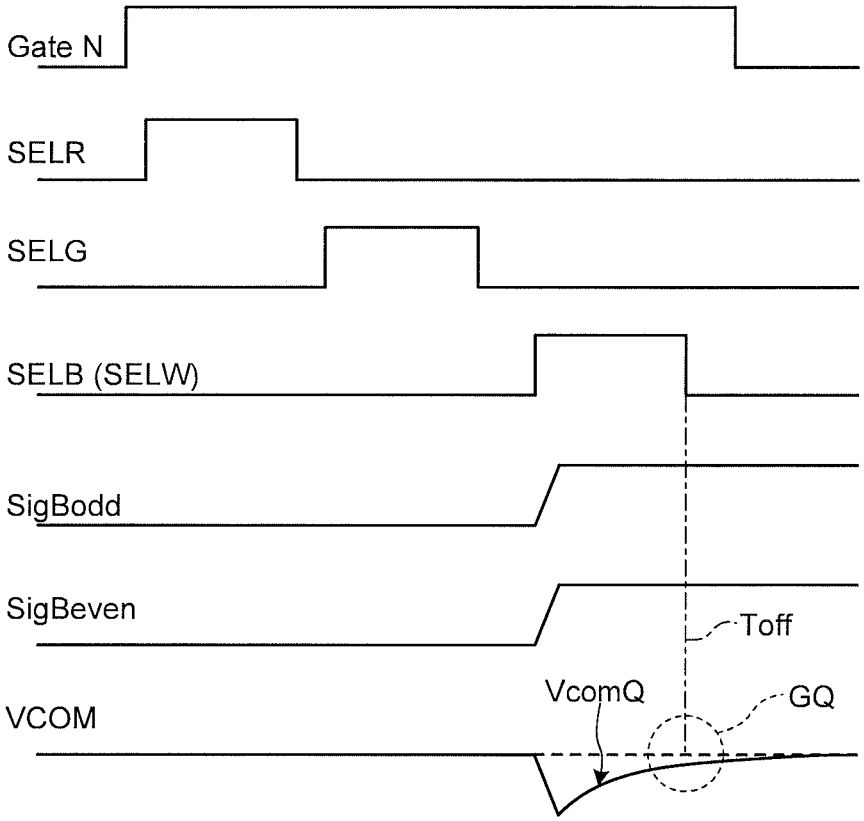
FIG. 14 is a schematic diagram for explaining the waveform of a signal of a common electrode when the monochromatic display is performed at the center of the image display panel according to the comparative example.

As illustrated in FIG. 10, a period Fodd of the application state PCodd illustrated in FIG. 8 and a period Feven of the application state PCeven illustrated in FIG. 9 are alternately repeated with a writing period Fg interposed therebetween as a boundary. FIG. 11 is a schematic diagram for explaining crosstalk generated in the image display panel according to a comparative example. FIG. 12 is a schematic diagram illustrating a pixel array of the image display panel according to the comparative example. FIG. 13 is a schematic diagram for explaining states of the sub-pixels when monochromatic display is performed at the center of the image display panel according to the comparative example. FIG. 14 is a schematic diagram for explaining the waveform of a signal of the common electrode when the monochromatic display is performed at the center of the image display panel according to the comparative example. As illustrated in FIG. 11, the image display panel 30 displays a window image 30W in which only the third sub-pixel 49B is lit at the center thereof. The image display panel 30 performs intermediate color display 30C with the first sub-pixel 49R, the second sub-pixel 49G, the third sub-pixel 49B, and the fourth sub-pixel 49W lit on both sides of the window image 30W, the intermediate color display 30C providing, for example, neutral gray regions in which red (R), green (G), blue (B), and white (W) have the same numerical value of gradation. The same applies to upper and lower parts than the window image 30W in the image display panel 30. As illustrated in FIG. 10, a polarity inversion period of the pixel potential and the polarity inversion period of the signal line potential are substantially the same as the period Fodd or the period Feven.

As illustrated in FIG. 12, in the image display panel according to the comparative example, the third sub-pixel 49B and the fourth sub-pixel 49W in the same row across the third columns are coupled to the same scanning line SCL. As illustrated in FIGS. 12 and 13, when the scanning circuit 42 selects GateN of the scanning line SCL, the sub-pixel 49B of SigBeven has the potential of minus (−) polarity, and the sub-pixel 49W in an upper row is black display, that is, 0 V. Accordingly, when the scanning circuit 42 scans GateN−1 and GateN of the scanning lines SCL, a voltage change in the sub-pixel 49B of SigBeven from GateN−1 to GateN is a decrease (minus). The sub-pixel 49W of SigBodd is black display, that is, 0 V, and the sub-pixel 49B in the upper row has the potential of plus (+) polarity. Accordingly, when the scanning circuit 42 scans GateN−1 and GateN of the scanning lines SCL, a voltage change in the sub-pixel 49W of SigBodd is a decrease (minus).

As described above, the signal lines DTL and the coupling capacitances C affect the common electrode COML. Accordingly, as illustrated in FIG. 14, the potential of the common electrode COML is changed in the decreasing direction due to the change in the sub-pixel 49B of SigBeven and the change in the sub-pixel 49W of SigBodd, that is, increases in the voltage. When a voltage VcomQ of a crosstalk component does not converge by a time Toff when a period of a sub-pixel 49B selector signal SELB is finished, a voltage difference GQ inevitably increases an effective voltage of the fourth sub-pixel 49W, and an unintended image may appear in the intermediate color display 30C. Influence of a variation in the luminance of the fourth sub-pixel 49W tends to be larger than a variation in the luminance of the other sub-pixel 49.

When different voltages having opposite polarities are applied to adjacent signal lines DTL and the polarities of the voltages to be applied are inverted at predetermined cycles, the potential of the common electrode COML is changed to be decreased. In the image display panel 30, even when the sub-pixels 49R and 49G are lit together with the sub-pixel 49B in response to the selector signals SELR and SELG and colors such as magenta and cyan are displayed in the window image 30W, if the voltage VcomQ of the crosstalk component does not converge, the voltage difference GQ increases the effective voltage of the fourth sub-pixel 49W and an unintended image may appear in the intermediate color display 30C.

Figure 15:
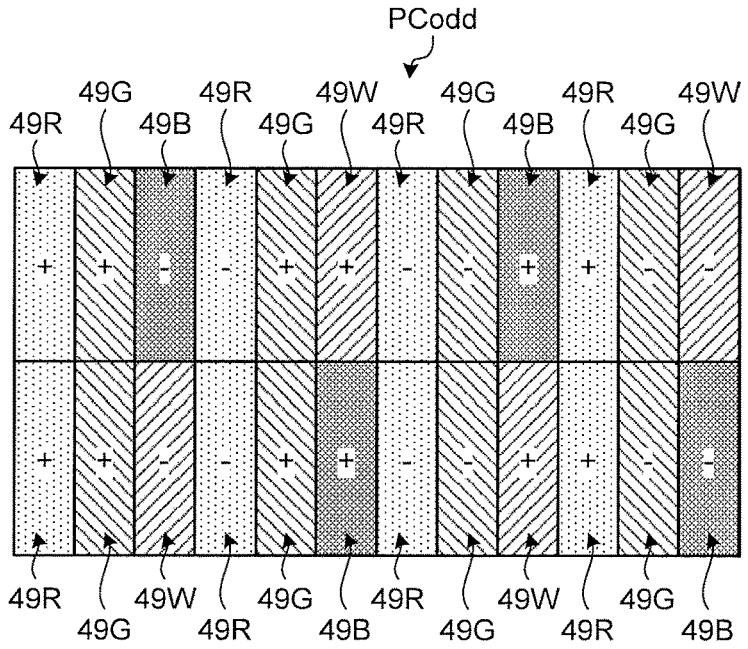
FIG. 15 is a schematic diagram for explaining a region in which the column inversion driving is displayed in the image display panel according to the embodiment.
Figure 16:
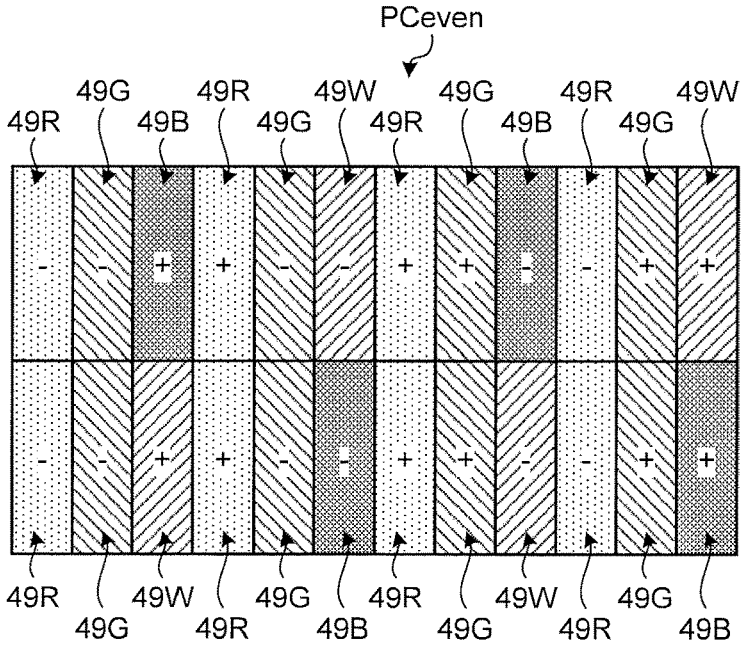
FIG. 16 is a schematic diagram for explaining the region in which the column inversion driving is displayed in the image display panel according to the embodiment.

FIGS. 15 and 16 are schematic diagrams for explaining a region in which the column inversion driving is displayed in the image display panel according to the embodiment. As illustrated in FIGS. 15 and 16, in the display panel according to the embodiment, for example, for each pixel in the row direction corresponding to the first sub-pixel 49R, the second sub-pixel 49G, and the third sub-pixel 49B (fourth sub-pixel 49W), the application state PCodd illustrated in FIG. 15 and the application state PCeven illustrated in FIG. 16 are alternately repeated with a potential (hereinafter, referred to as a plus (+) polarity) higher than a reference potential and another potential (hereinafter, referred to as a minus (−) polarity) lower than the reference potential, the reference potential being set to the potential of the common electrode. In the embodiment, the reference potential is set to the potential of the common electrode. However, the reference potential is not limited to the potential of the common electrode, and may be a predetermined potential. In this way, in the column inversion, the voltages are applied so that potentials may be different relative to the reference potential between adjacent two columns of sub-pixel columns, and the polarities of the voltages to be applied are inverted at predetermined cycles. This method is called two-column inversion. In this two-column inversion, different voltages (for example, opposite polarities) are applied to signal lines of adjacent two columns of sub-pixel columns, and the polarities of the voltages to be applied are inverted at predetermined cycles.

Figure 17:
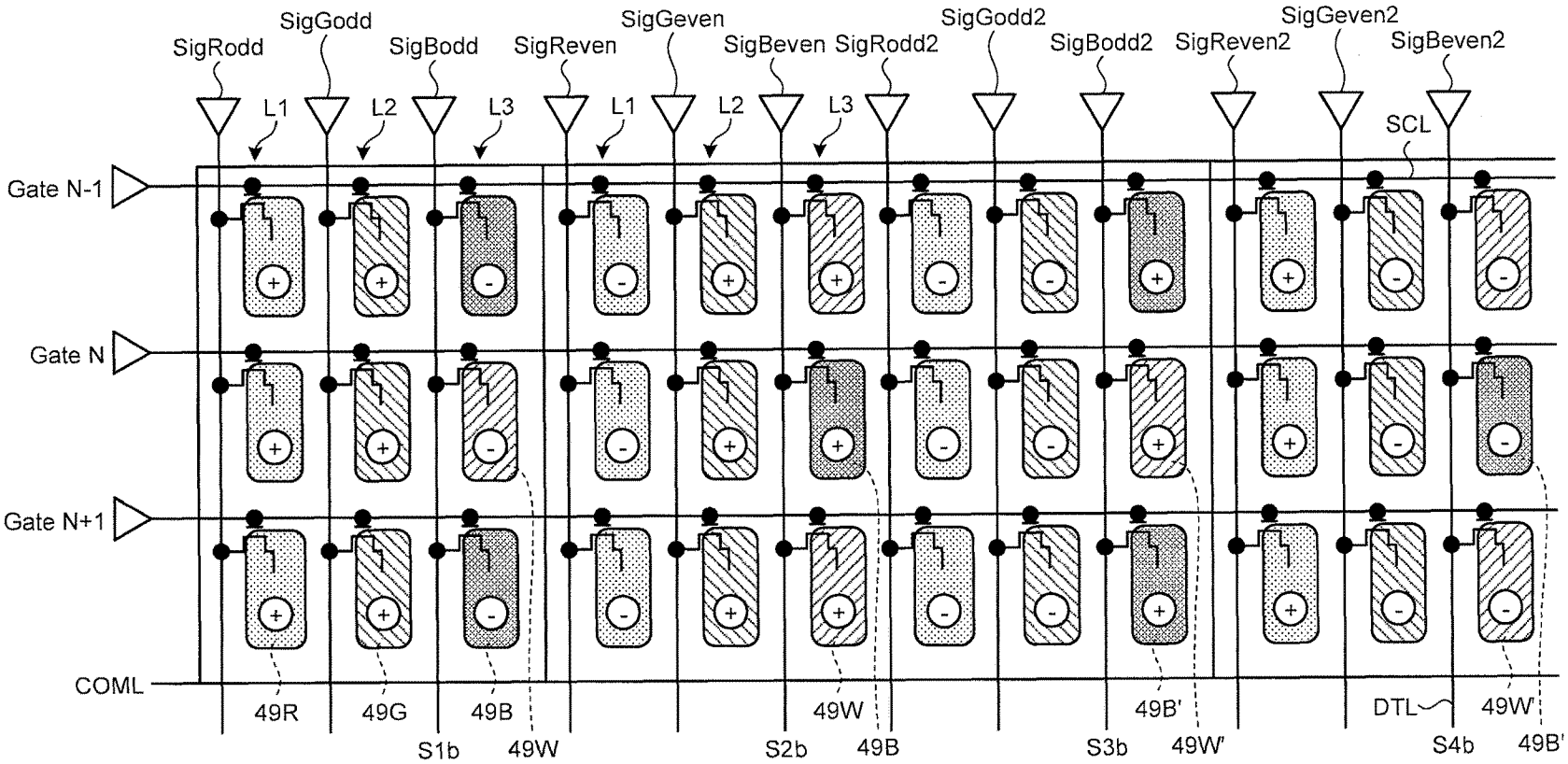
FIG. 17 is a schematic diagram illustrating a pixel array of the image display panel according to the embodiment.
Figure 18:
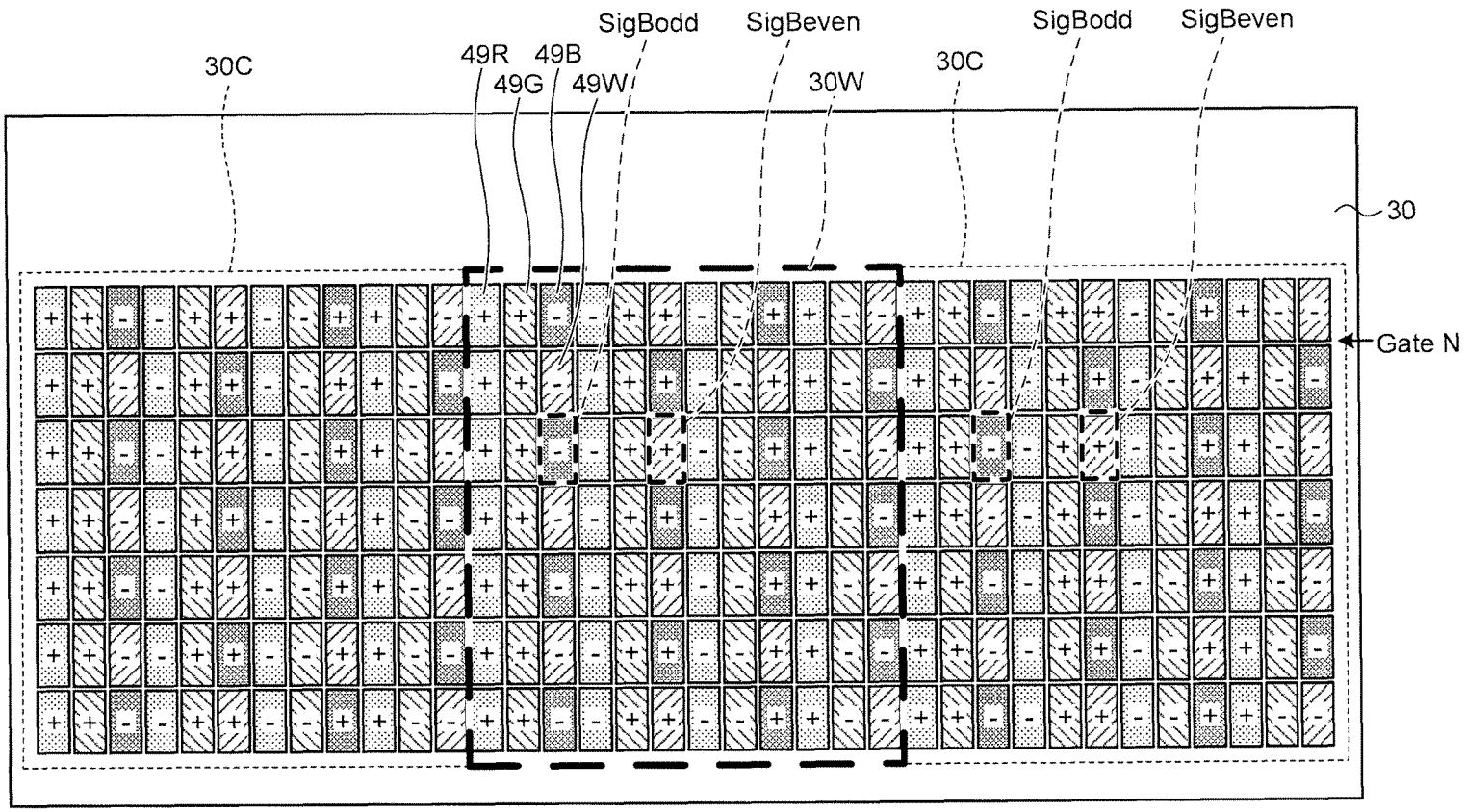
FIG. 18 is a schematic diagram for explaining states of sub-pixels when the monochromatic display is performed at the center of the image display panel according to the embodiment.
Figure 19:
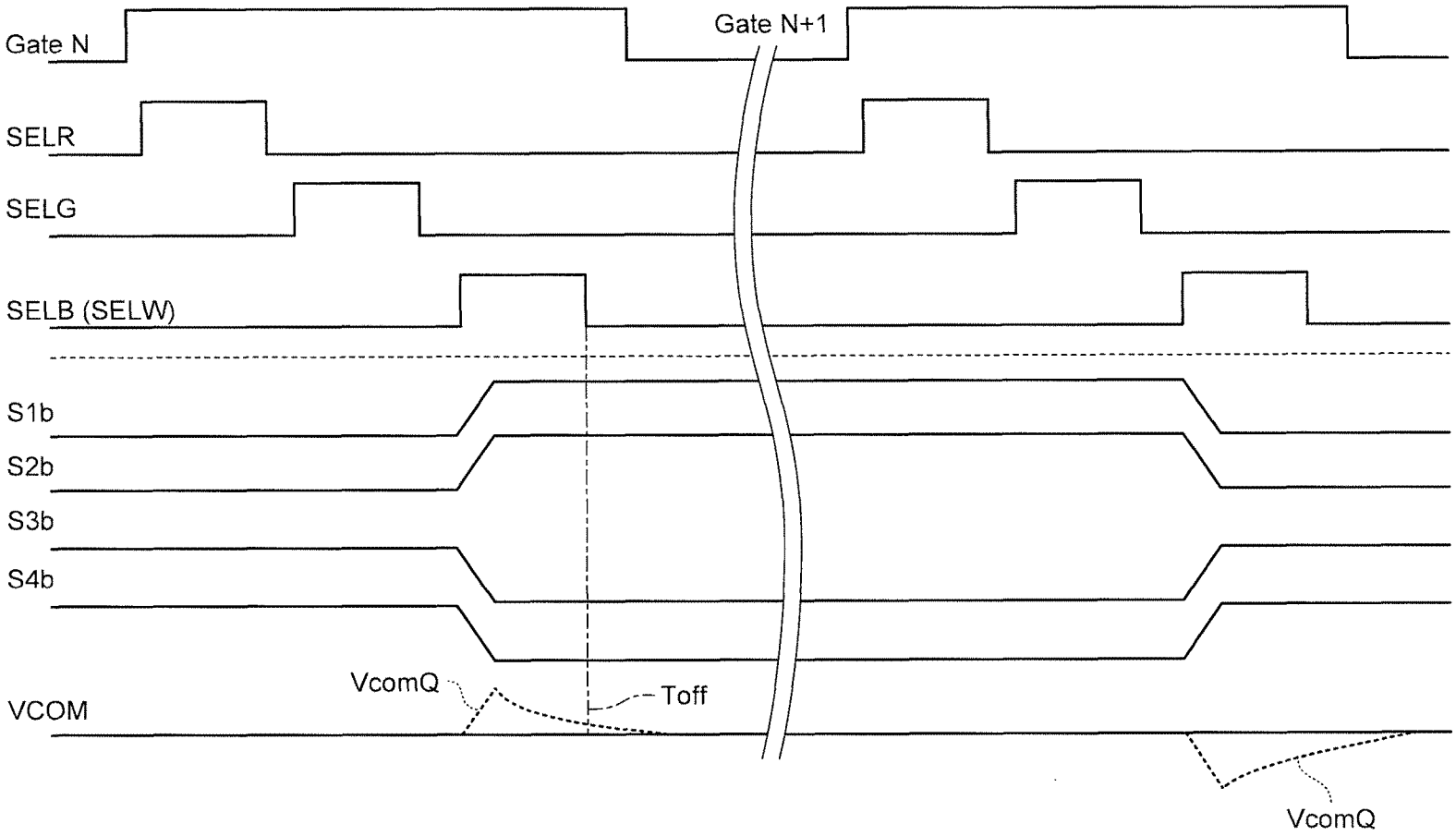
FIG. 19 is a schematic diagram for explaining the waveform of a signal of a common electrode when the monochromatic display is performed at the center of the image display panel according to the embodiment.

As illustrated in FIG. 10, the period Fodd of the application state PCodd illustrated in FIG. 15 and the period Feven of the application state PCeven illustrated in FIG. 16 are alternately repeated with the writing period Fg interposed therebetween as a boundary. FIG. 17 is a schematic diagram illustrating the pixel array of the image display panel according to the embodiment. FIG. 18 is a schematic diagram for explaining states of the sub-pixels when the monochromatic display is performed at the center of the image display panel according to the embodiment. FIG. 19 is a schematic diagram for explaining the waveform of a signal of the common electrode when the monochromatic display is performed at the center of the image display panel according to the embodiment.

As illustrated in FIG. 17, in the embodiment, the image display panel has a pixel array in which a third sub-pixel column L3 (specified sub-pixel column) including the third sub-pixels 49B and the fourth sub-pixels 49W and at least one of the other sub-pixel columns (the first sub-pixel column L1 and the second sub-pixel column L2) arranged next to the third sub-pixel columns L3 including the third sub-pixels 49B and the fourth sub-pixels 49W are periodically arranged. In the example illustrated in FIG. 17, the first sub-pixel column L1, which is adjacent to the third sub-pixel column L3 and includes the first sub-pixels 49R, is arranged next to the third sub-pixel column L3 including the third sub-pixels 49B and the fourth sub-pixels 49W. The second sub-pixel column L2 including the second sub-pixels 49G is arranged next to the first sub-pixel column L1. The third sub-pixel column L3 including the third sub-pixel 49B and the fourth sub-pixel 49W is arranged next to the second sub-pixel column L2. The first sub-pixel column L1 to the third sub-pixel column L3 are periodically arranged. The third sub-pixels 49B and the fourth sub-pixels 49W in the same row across the third sub-pixel columns L3 are coupled to the same scanning line SCL. In the third sub-pixel column L3, the third sub-pixels 49B and the fourth sub-pixels 49W are alternately arranged in a direction along the third sub-pixel column L3. Across the third sub-pixel columns L3, in the same row, the third sub-pixels 49B and fourth sub-pixels 49W are alternately arranged so that sub-pixels in each adjacent two of the third sub-pixel columns L3 in the direction along the row direction may be the third sub-pixel 49B and the fourth sub-pixel 49W. The pixel array of the image display panel is not limited to the example illustrated in FIG. 17. Alternatively, for example, other sub-pixels may be arranged between the third sub-pixel columns L3 adjacent to each other in a direction along the same row.

In the embodiment, the voltage having the same polarity is applied to the signal line of a specified third sub-pixel column belonging to the third sub-pixel columns and the signal line of the first sub-pixel column or the second sub-pixel column adjacent to the specified third sub-pixel column. In the example illustrated in FIG. 17, the voltage having the same polarity is applied to the signal lines (DTL) of a specified third sub-pixel column (for example, SigBeven) belonging to the third sub-pixel columns and the second sub-pixel column (SigGeven) adjacent to the specified third sub-pixel column, and the voltage having a different polarity (for example, an opposite polarity) is applied to the first sub-pixel column (SigRodd2). The voltage having the same polarity is applied to the signal lines (DTL) of another specified third sub-pixel column (for example, SigBodd) belonging to the third sub-pixel columns and the first sub-pixel column (SigReven) adjacent to the specified third sub-pixel column, and the voltage having a different polarity (for example, an opposite polarity) is applied to the second sub-pixel column (SigGodd).

In the embodiment, with regard to two third sub-pixel columns (SigBodd and Sigodd2) adjacent to the specified third sub-pixel column (SigBeven) in a direction along the row direction, the voltage having the same polarity as the voltage applied to the specified third sub-pixel column (SigBeven) is applied to the signal line DTL of one (Sigodd2) of the two third sub-pixel columns. At the same time, the voltage having a polarity (for example, an opposite polarity) different from the specified third sub-pixel column (SigBeven) is applied to the signal line DTL of the other one (SigBodd) of the two third sub-pixel columns.

For example, as illustrated in FIGS. 17 and 18, when the scanning circuit 42 selects GateN from among scanning lines SCL, the sub-pixel 49W of SigBodd is black display, that is, 0 V, and the sub-pixel 49B in the upper row has the potential of minus (−) polarity. Accordingly, when the scanning circuit 42 scans GateN−1 and GateN of the scanning lines SCL, a voltage change in the sub-pixel 49W of SigBodd is an increase (plus). The sub-pixel 49B of SigBeven has the potential of plus (+) polarity, and the sub-pixel 49W in the upper row is black display, that is, 0 V. Accordingly, when the scanning circuit 42 scans GateN−1 and GateN of the scanning lines SCL, a voltage change in the sub-pixel 49B of SigBeven is an increase (plus).

Similarly, when the scanning circuit 42 selects GateN among the scanning lines SCL, the sub-pixel 49W' of SigBodd2 is black display, that is, 0 V, and the sub-pixel 49B' in the upper row has the potential of plus (+) polarity. Accordingly, when the scanning circuit 42 scans GateN−1 and GateN of the scanning lines SCL, a voltage change in the sub-pixel 49W' of SigBodd2 is a decrease (minus). The sub-pixel 49B' of SigBeven2 has the electric potential of minus (−) polarity, and the sub-pixel 49W' in the upper row is black display, that is, 0 V. Accordingly, when the scanning circuit 42 scans GateN−1 and GateN of the scanning lines SCL, a voltage change in the sub-pixel 49B' of SigBeven2 from GateN−1 to GateN is a decrease (minus). As a result, as illustrated in FIG. 19, signal line variations S1*b* and S2*b* of the sub-pixel 49W of SigBodd and the sub-pixel 49B of SigBeven into the potential of plus (+) polarity and signal line variations S3*b* and S4*b* of the sub-pixel 49W' of SigBodd2 and sub-pixel 49B' of SigBeven2 into the potential of minus (−) polarity cancel each other, so that a variation in the electric potential of the common electrode COML is suppressed. Accordingly, the voltage VcomQ of the crosstalk component converges by the time Toff when the period of the sub-pixel 49B selector signal SELB is finished, the effective voltage of the fourth sub-pixel 49W in which the luminance is easily varied is prevented from increasing because of the voltage difference GQ, and an unintended image in the intermediate color display 30C (FIG. 11) can be prevented from appearing.

As described above, in the embodiment, the column inversion driving is performed. The column inversion driving includes: applying the voltage having the same polarity to the signal line of the first sub-pixel column or the second sub-pixel column adjacent to the third sub-pixel column; at the same time, applying the voltage having the same polarity as a specified third sub-pixel column to the signal line DTL of one of the two third sub-pixel columns next to the specified third sub-pixel column in a direction along the row direction; at the same time, applying the voltage having a polarity (for example, an opposite polarity) different from the specified third sub-pixel column to the signal line DTL of the other one of the two third sub-pixel column; and inverting the polarities of voltages to be applied at predetermined cycles. In other words, in the embodiment, among the first sub-pixel column to the third sub-pixel column that are periodically arranged, the column inversion driving is performed in such a manner as to apply the voltage having the same polarity to adjacent two columns of signal lines, apply the voltage having a different polarity to subsequent two columns to the adjacent two columns above of signal lines, and invert the polarity of the voltage to be applied at predetermined cycles. As a result, increases and decreases in the coupling capacitances C cancel each other even when the signal lines DTL and the coupling capacitances C affect the common electrode COML, so that the display device 10 can suppress the change in the potential of the common electrode COML even when the signal processing unit 20 performs the column inversion driving on the signal lines DTL.

The voltage VcomQ of the crosstalk component converges by the time Toff when the period of display selection SELB of the sub-pixel 49B is finished, so that an unintended image that is not originally generated can be prevented from appearing in the intermediate color display 30C. As a result, between when the window image 30W is displayed and when it is not, a change in effective potential per frame of the pixel potential is small. Thus, when the display device 10 according to the embodiment is driven by the column inversion driving method, a change in effective potential per frame of the pixel potential can be suppressed between when the window image 30W is displayed and when it is not. In addition, power consumption can be suppressed when the display device 10 is driven by the column inversion driving method rather than the dot inversion driving method. In the image display panel 30 according to the embodiment, the sub-pixel 49R and the sub-pixel 49G are lit together with the sub-pixel 49B in response to the selector signals SELR and SELG. The voltage VcomQ of the crosstalk component is suppressed even when colors such as magenta and cyan are displayed in the window image 30W, which reduces the possibility that an unintended image appears in the intermediate color display 30C.

In the above embodiment, as illustrated in FIG. 17, it is preferred that a sub-pixel column group, including a third sub-pixel column and the first sub-pixel column or the second sub-pixel column adjacent to the third sub-pixel column, to which the voltage of a polarity (plus (+)) is applied and another sub-pixel column group, including another third sub-pixel column and the first sub-pixel column or the second sub-pixel column, to which the voltage of the other polarity (minus (−)) is applied be substantially equalized. This arrangement can reduce a difference between a change in the signal line potential toward the plus (+) polarity and a change in the signal line potential toward the minus polarity (−) in the image display panel, so that image display is further improved.

In the above embodiment, a third sub-pixel column and the first sub-pixel column or the second sub-pixel column adjacent to the third sub-pixel column are selected together, and an image signal having the same polarity is applied to each of the third sub-pixels 49B and the first sub-pixels 49R or the second sub-pixels 49G. In this case, when magenta is displayed with the third sub-pixel column and the first sub-pixel column in the image display panel 30, a predetermined potential (for example, +3.6 V or −3.6 V) is sequentially applied to the first sub-pixel column. On the other hand, the fourth sub-pixels 49W (0 V) and the predetermined potential of the third sub-pixels 49B (for example, +3.6 V or −3.6 V) are alternately applied to the third sub-pixel column. Accordingly, the change in potential of the signal line DTL when the scanning circuit 42 sequentially scans the third sub-pixel column is larger than the change in potential of the signal line DTL when the scanning circuit 42 sequentially scans the first sub-pixel column. When the image signal is written in the sub-pixel 49 in order of the first sub-pixel column and the third sub-pixel column, the change in potential of the signal line DTL of the third sub-pixel column affects the signal line DTL of the first sub-pixel column, and a stripe may appear in an image displayed on the display panel.

Similarly, when cyan is displayed with the third sub-pixel column and the second sub-pixel column in the image display panel 30, the predetermined potential (for example, +3.6 V or −3.6 V) is sequentially applied to the second sub-pixel column. On the other hand, the fourth sub-pixels 49W (0 V) and the predetermined potential of the third sub-pixels 49B (for example, +3.6 V or −3.6 V) are alternately applied to the third sub-pixel column. Accordingly, the change in potential of the signal line DTL when the scanning circuit 42 sequentially scans the third sub-pixel column is larger than the change in potential of the signal line DTL when the scanning circuit 42 sequentially scans the second sub-pixel column. When the image signal is written in the sub-pixel 49 in order of the second sub-pixel column and the third sub-pixel column, the change in potential of the signal line DTL of the third sub-pixel column affects the signal line DTL of the second sub-pixel column, and a stripe may appear in the image.

Figure 20:
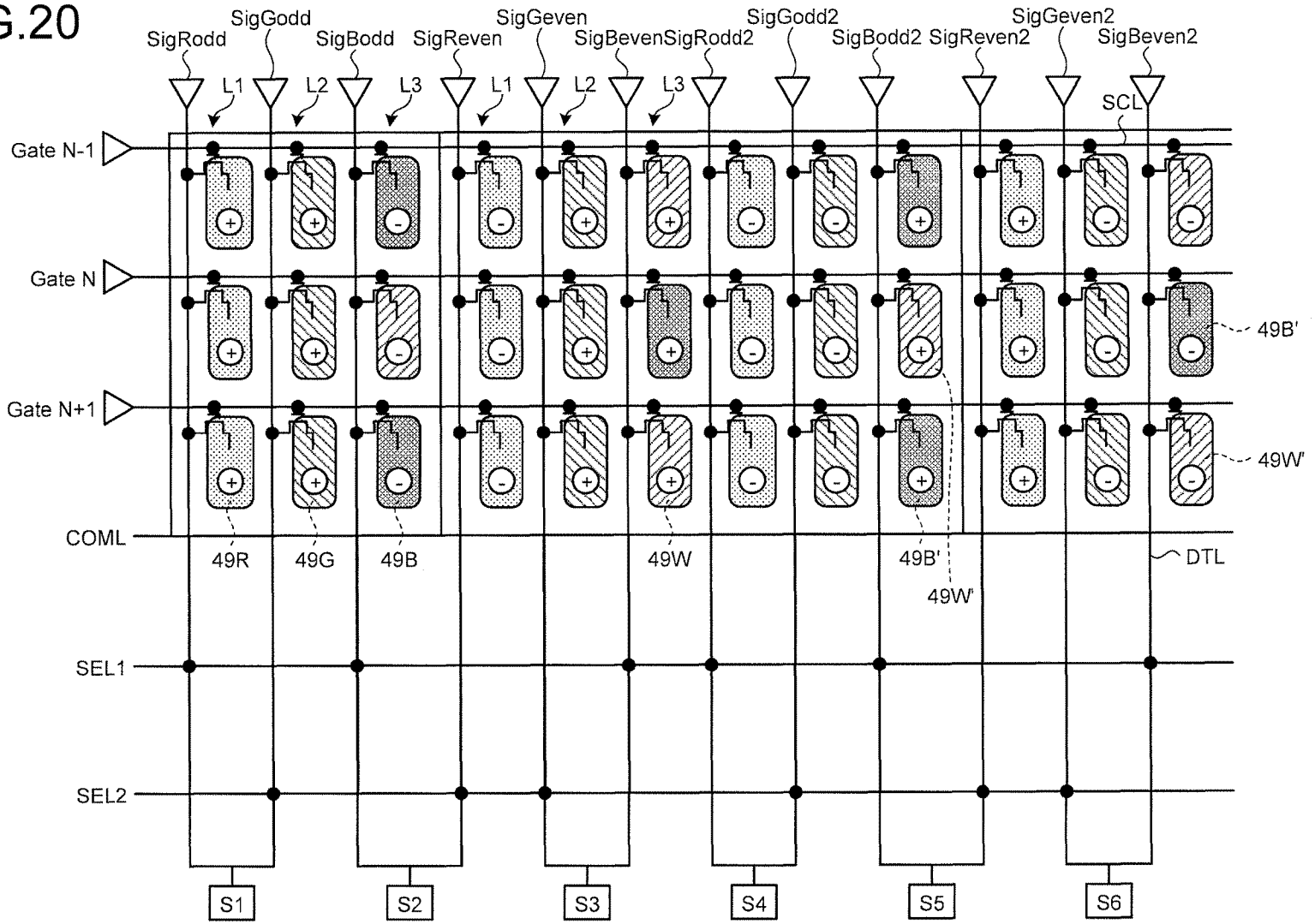
FIG. 20 is an explanatory diagram of an example of a driving order of the image display panel according to the embodiment.

In the embodiment, the appearance of stripes in the image described above are prevented by changing a driving order of the image display panel. FIG. 20 is an explanatory diagram of an example of the driving order of the image display panel according to the embodiment. As illustrated in FIG. 20, in the embodiment, a pair among the first sub-pixel columns L1 to the third sub-pixel columns L3 to which the voltage having the same polarity is applied is coupled to the same source amplifier among a first source amplifier S1 to a sixth source amplifier S6 via the signal line DTL. The first source amplifier S1 to the sixth source amplifier S6 sequentially drive the first sub-pixel columns L1 to the third sub-pixel columns L3 in response to a first selector signal SEL1 and a second selector signal SEL2 that are sequentially supplied.

The first sub-pixel column L1 of SigRodd and the second sub-pixel column L2 of SigGodd are coupled to the first source amplifier S1, and the voltage of plus (+) polarity is applied thereto. The first selector signal SEL1 is supplied to the first sub-pixel column L1 of SigRodd coupled to the first source amplifier S1, and the second selector signal SEL2 is supplied to the second sub-pixel column L2 of SigGodd. Accordingly, the first source amplifier S1 drives the first sub-pixel column L1 and the second sub-pixel column L2 in this order.

The third sub-pixel column L3 of SigBodd and the first sub-pixel column L1 of SigReven are coupled to the second source amplifier S2, and the voltage of minus (−) polarity is applied thereto. The first selector signal SELL is supplied to the third sub-pixel column L3 of SigBodd coupled to the second source amplifier S2, and the second selector signal SEL2 is supplied to the first sub-pixel column L1 of SigReven. Accordingly, the second source amplifier S2 drives the third sub-pixel column L3 and the first sub-pixel column L1 in this order.

The second sub-pixel column L2 of SigGeven and the third sub-pixel column L3 of SigBeven are coupled to the third source amplifier S3, and the voltage of plus (+) polarity is applied thereto. The first selector signal SEL1 is supplied to the third sub-pixel column L3 of SigBeven coupled to the third source amplifier S3, and the second selector signal SEL2 is supplied to the second sub-pixel column L2 of SigGeven. Accordingly, the third source amplifier S3 drives the third sub-pixel column L3 and the second sub-pixel column L2 in this order.

The first sub-pixel column L1 of SigRodd and the second sub-pixel column L2 of SigGodd are coupled to the fourth source amplifier S4, and the voltage of minus (−) polarity is applied thereto. The first selector signal SEL1 is supplied to the first sub-pixel column L1 of SigRodd coupled to the fourth source amplifier S4, and the second selector signal SEL2 is supplied to the second sub-pixel column L2 of SigGodd. Accordingly, the fourth source amplifier S4 drives the first sub-pixel column L1 and the second sub-pixel column L2 in this order.

The third sub-pixel column L3 of SigBodd and the first sub-pixel column L1 of SigReven are coupled to the fifth source amplifier S5, and the voltage of plus (+) polarity is applied thereto. The first selector signal SEL1 is supplied to the third sub-pixel column L3 of SigBodd coupled to the fifth source amplifier S5, and the second selector signal SEL2 is supplied to the first sub-pixel column L1 of SigReven. Accordingly, the fifth source amplifier S5 drives the third sub-pixel column L3 and the first sub-pixel column L1 in this order.

The second sub-pixel column L2 of SigGeven and the third sub-pixel column L3 of SigBeven are coupled to the sixth source amplifier S6, and the voltage of minus (−) polarity is applied thereto. The first selector signal SELL is supplied to the third sub-pixel column L3 of SigBeven coupled to the sixth source amplifier S6, and the second selector signal SEL2 is supplied to the second sub-pixel column L2 of SigGeven. Accordingly, the sixth source amplifier S6 drives the third sub-pixel column L3 and the second sub-pixel column L2 in this order.

As described above, according to the embodiment, even when cyan or magenta is displayed on the image display panel 30, the voltage is first applied to the third sub-pixel column L3 and the first sub-pixel column L1 in response to the first selector signal SELL Subsequently, the voltage is applied to the first sub-pixel column L1 and the second sub-pixel column L2 in response to the second selector signal SEL2. As a result, the image signal is preferentially written in the third sub-pixel column L3, the voltage variation of which is the larger in a pair of sub-pixel columns to which the voltage having the same polarity is applied, so that the appearance of a stripe in the image due to the voltage variation can be prevented, and display quality of the image display panel can be improved. The above embodiment describes an example of applying the voltage to the second sub-pixel column L2 with the second selector signal SEL2. Alternatively, the voltage may be applied to the first sub-pixel column L1 with the second selector signal SEL2.

Figure 21:
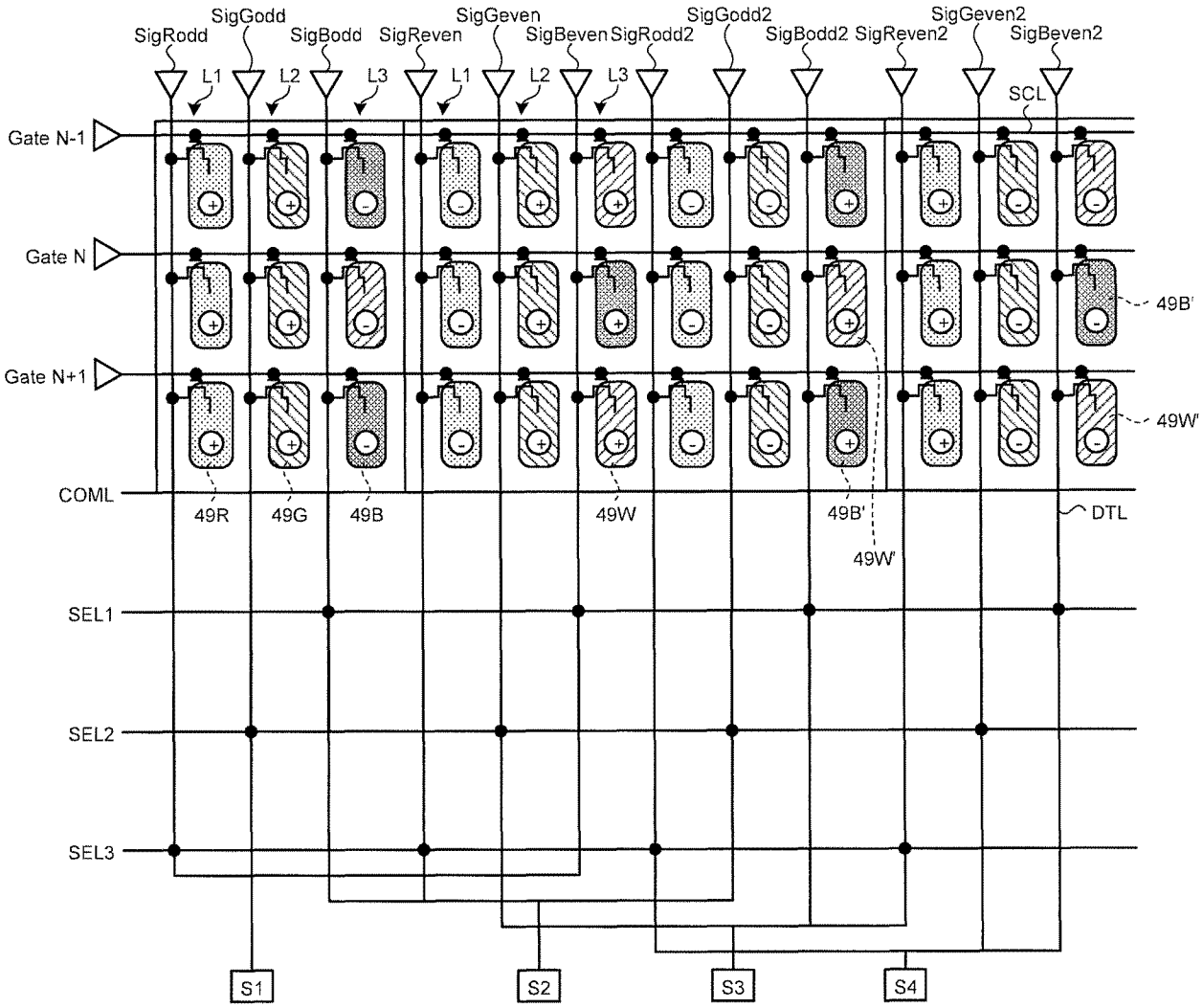
FIG. 21 is an explanatory diagram of another example of the driving order of the image display panel according to the embodiment.

FIG. 21 is an explanatory diagram of another example of the driving order of the image display panel according to the embodiment. In the example illustrated in FIG. 21, a group among the first sub-pixel columns L1 to the third sub-pixel columns L3 to which the voltage having the same polarity is applied is coupled to a corresponding source amplifier among a first source amplifier S1 to a fourth source amplifier S4 via the signal line DTL. The first source amplifier S1 to the fourth source amplifier S4 sequentially drive the first sub-pixel column L1 to the third sub-pixel column L3 corresponding to a first selector signal SEL1 to a third selector signal SEL3 that are sequentially supplied.

The first sub-pixel column L1 of SigRodd, the second sub-pixel column L2 of SigGodd, and the third sub-pixel column L3 of SigBeven are coupled to the first source amplifier S1, and the voltage of plus (+) polarity is applied thereto. The first selector signal SEL1 is supplied to the third sub-pixel column L3 of SigBeven coupled to the first source amplifier S1, the second selector signal SEL2 is supplied to the second sub-pixel column L2 of SigGodd, and the third selector signal SEL3 is supplied to the first sub-pixel column L1 of SigRodd. Accordingly, the first source amplifier S1 drives the third sub-pixel column L3, the second sub-pixel column L2, and the first sub-pixel column L1 in this order.

The third sub-pixel column L3 of SigBodd, the second sub-pixel column L2 of SigGodd, and the first sub-pixel column L1 of SigReven are coupled to the second source amplifier S2, and the voltage of minus (−) polarity is applied thereto. The first selector signal SEL1 is supplied to the third sub-pixel column L3 of SigBodd coupled to the second source amplifier S2, the second selector signal SEL2 is supplied to the second sub-pixel column L2 of SigGodd, and the third selector signal SEL3 is supplied to the first sub-pixel column L1 of SigReven. Accordingly, the second source amplifier S2 drives the third sub-pixel column L3, the second sub-pixel column L2, and the first sub-pixel column L1 in this order.

The second sub-pixel column L2 of SigGeven, the third sub-pixel column L3 of SigBodd, and the first sub-pixel column L1 of SigReven are coupled to the third source amplifier S3, and the voltage of plus (+) polarity is applied thereto. The first selector signal SELL is supplied to the third sub-pixel column L3 of SigBodd coupled to the third source amplifier S3, the second selector signal SEL2 is supplied to the second sub-pixel column L2 of SigGeven, and the third selector signal SEL3 is supplied to the first sub-pixel column L1 of SigReven. Accordingly, the third source amplifier S3 drives the third sub-pixel column L3, the second sub-pixel column L2, and the first sub-pixel column L1 in this order.

The first sub-pixel column L1 of SigRodd, the second sub-pixel column L2 of SigGeven, and the third sub-pixel column L3 of SigBeven are coupled to the fourth source amplifier S4, and the voltage of minus (−) polarity is applied thereto. The first selector signal SEL1 is supplied to the third sub-pixel column L3 of SigBeven coupled to the fourth source amplifier S4, the second selector signal SEL2 is supplied to the second sub-pixel column L2 of SigGeven, and the third selector signal SEL3 is supplied to the first sub-pixel column L1 of SigRodd. Accordingly, the fourth source amplifier S4 drives the third sub-pixel column L3, the second sub-pixel column L2, and the first sub-pixel column L1 in this order.

As described above, according to the embodiment, even when cyan or magenta is displayed on the image display panel 30, the voltage is first applied to the third sub-pixel column L3 in response to the first selector signal SEL1, subsequently, the voltage is applied to the second sub-pixel column L2 in response to the second selector signal SEL2, and thereafter, the voltage is applied to the first sub-pixel column L1 in response to the third selector signal SEL3. As a result, the image signal is preferentially written in the third sub-pixel column L3 the voltage variation of which is large, so that the appearance of stripes in the image due to the voltage variation in the third sub-pixel column L3 can be prevented, and the display quality of the image display panel can be improved. More specifically, the appearance of stripes in the image due to the voltage variation can be prevented by first writing a column of the third sub-pixels 49B of blue and the fourth sub-pixels 49W of white, and writing the first column of the first sub-pixels 49R of red to the second column of the second sub-pixels 49G of green thereafter. The above embodiment describes an example of applying the voltage to the second sub-pixel column L2 with the second selector signal SEL2. Alternatively, the voltage may be applied to the first sub-pixel column L1 with the second selector signal SEL2.

Advantageous Effects

As described above, in the display device 10, a white pixel, that is, the fourth sub-pixel 49W can be added to the first sub-pixel 49R of red, the second sub-pixel 49G of green, and the third sub-pixel 49B of blue. As the white pixel improves the luminance, the current value of the backlight is reduced and the power consumption is reduced. The display device 10 performs the column inversion driving, so that charge and discharge amounts are suppressed for each signal line DTL and the power consumption is further reduced.

In the image display panel 30, three columns of the first sub-pixels 49R, the second sub-pixels 49G, and the third sub-pixels 49B are sequentially arranged. In the third column, the third sub-pixels 49B and the fourth sub-pixels 49W are alternately arranged in the column direction. As a result, the pixel area can be prevented from being increased even when the fourth sub-pixel 49W is added, and high definition can be achieved. In the display device 10, the signal processing unit 20 performs the column inversion driving for every two columns in such a manner as to apply voltages having opposite polarities in every two sub-pixel columns via the signal line DTL for every adjacent two sub-pixel columns and invert the polarities of the voltages to be applied at predetermined cycles, so that the power consumption can be suppressed. The display device 10 can prevent deterioration in the display quality called crosstalk.

With reference to Table 1 below, the following describes an effect of reducing noise to the outside in the column inversion driving according to the embodiment in comparison with conventional column inversion driving according to the comparative example illustrated in FIG. 12. A result indicated in Table 1 is potential variations (mv) of red (R), green (G), blue (B), and white (W) measured with an oscilloscope when a metal cylinder having a diameter of 1 cm coupled to the oscilloscope is arranged on the liquid crystal display panel to display an image using the column inversion driving method according to the comparative example and the embodiment. These values were obtained in measurement when the display screen for white (W) is set to a white screen.

TABLE 1

| | Comparative Example | Embodiment |
|---|---|---|
| R | 184 | 164 |
| G | 184 | 164 |
| B | 1200 | 254 |
| W | 171 | 154 |

As can be seen from Table 1, the potential variation (mv) can be reduced in any of red (R), green (G), blue (B), and white (W) by performing the column inversion driving according to the embodiment as compared with the column inversion driving according to the comparative example. Especially, the voltage variation in the third sub-pixel of blue (B) can be significantly reduced to be substantially one-fifth. This result is considered to be obtained because the electric potential variation in the common electrode COML can be prevented by the column inversion driving according to the embodiment, so that influence from the voltage VcomQ of the crosstalk component illustrated in FIG. 14 can be reduced.

3. Modifications

First Modification

Figure 22:
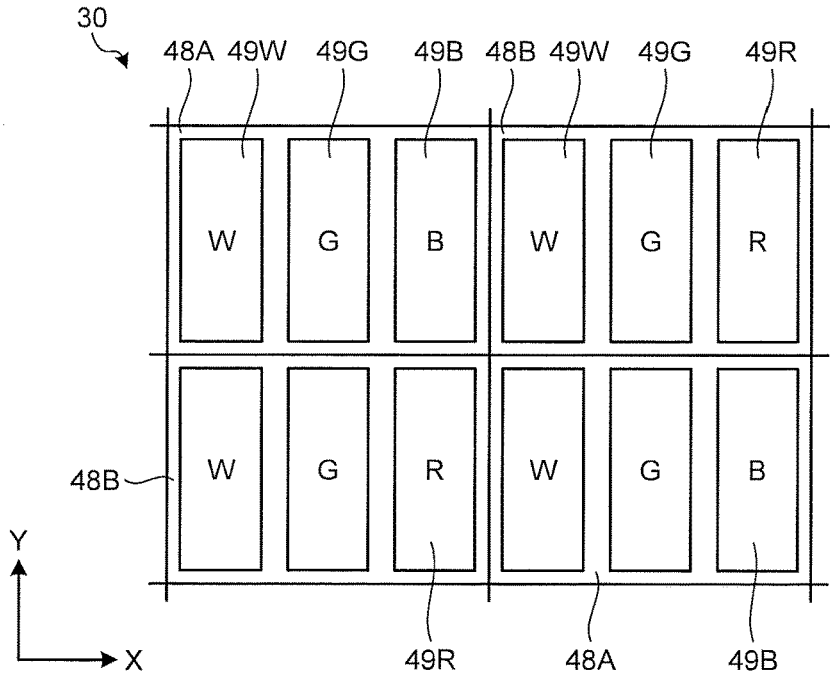
FIG. 22 is a conceptual diagram of an image display panel of a display device according to a first modification of the embodiment.

FIG. 22 is a conceptual diagram of the image display panel of the display device according to a first modification of the embodiment. In the pixels 48A and the pixels 48B of the image display panel 30, the first sub-pixel columns in which the first sub-pixels 49W of white are arranged, the second sub-pixel columns arranged next to the respective first sub-pixel columns in which the second sub-pixels 49G of green are arranged, and the third sub-pixel columns arranged next to the respective second sub-pixel columns are repeatedly arranged. The third sub-pixels 49B of blue and the fourth sub-pixels 49R of red are alternately arranged in the row direction across the third sub-pixel columns, and the third sub-pixels 49B and the fourth sub-pixels 49R are alternately arranged in the column direction in the same column of the third sub-pixel columns. Voltages applied to the first sub-pixel columns to the third sub-pixel columns are the same as the example illustrated in FIG. 17. With such an arrangement, the luminance of the first sub-pixels 49W of white is increased, so that a brighter image display panel can be obtained.

Second Modification

Figure 23:
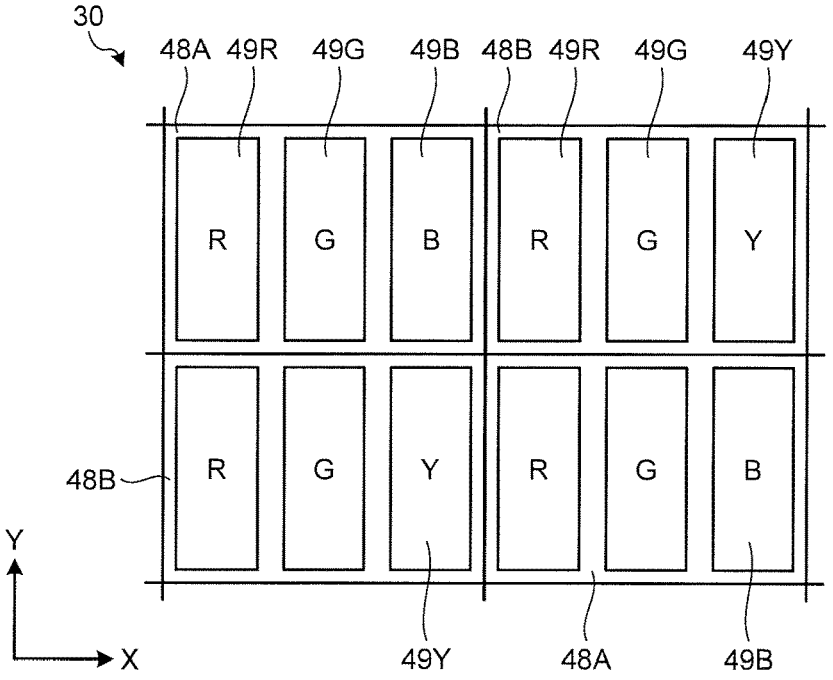
FIG. 23 is a diagram illustrating a pixel array of an image display panel of a display device according to a second modification of the embodiment.

FIG. 23 is a diagram illustrating the pixel array of the image display panel of the display device according to a second modification of the embodiment. In the pixels 48A and the pixels 48B of the image display panel 30, the first sub-pixel columns in which the first sub-pixels 49R of red are arranged, the second sub-pixel columns arranged next to the respective first sub-pixel columns in which the second sub-pixels 49G of green are arranged, and the third sub-pixel columns arranged next to the respective second sub-pixel columns are repeatedly arranged. The third sub-pixels 49B of blue and fourth sub-pixels 49Y of yellow are alternately arranged in the row direction across the third sub-pixel columns, and the third sub-pixels 49B and the fourth sub-pixels 49Y are alternately arranged in the column direction in the same column of the third sub-pixel columns. For example, a yellow color filter is arranged between the fourth sub-pixel 49Y and an image observer. Voltages applied to the first sub-pixel columns to the third sub-pixel columns are the same as the example illustrated in FIG. 17. With such an arrangement, an image display panel with wider color representation can be obtained.

Display Device Including Touch Detection Device

Figure 24:
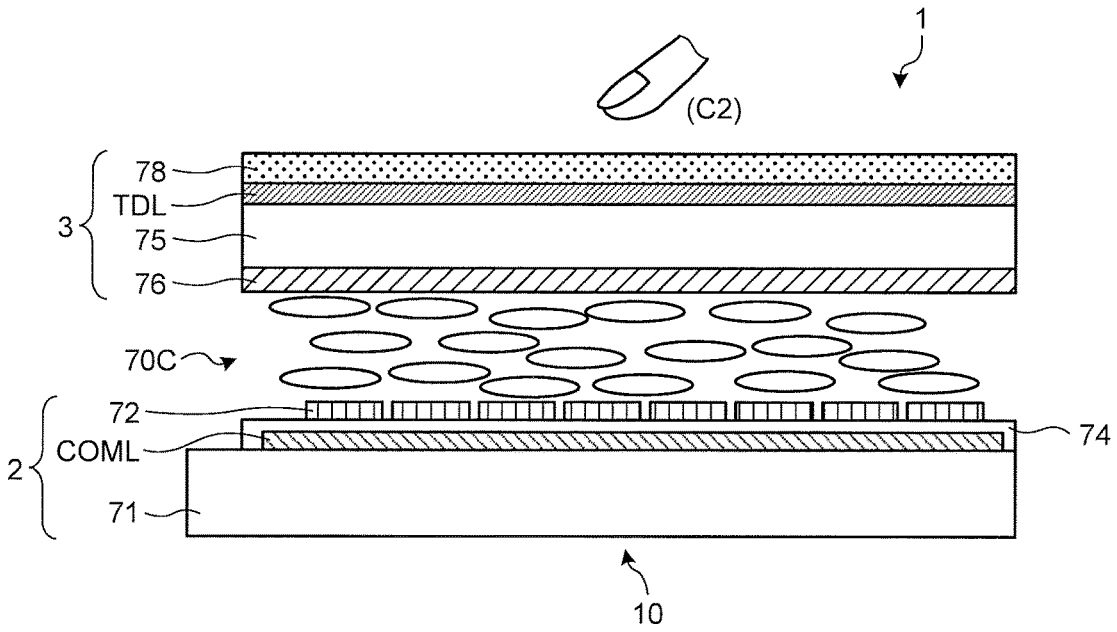
FIG. 24 is a conceptual diagram of the display device according to the embodiment in which a touch detection device is mounted on the image display panel.

FIG. 24 is a conceptual diagram of the display device according to the embodiment in which a touch detection device is integrally mounted on the image display panel. As illustrated in FIG. 24, the display device 10 includes a pixel substrate 2, a counter substrate 3 arranged so as to be opposed to the pixel substrate 2 in a direction perpendicular to a surface of the pixel substrate 2, and the liquid crystal layer 70C interposed between the pixel substrate 2 and the counter substrate 3.

The liquid crystal layer 70C modulates light passing therethrough in accordance with the state of the electric field. Used herein is a liquid crystal display device utilizing, as the liquid crystal layer 70C, liquid crystal of a lateral electric-field mode such as the FFS mode or the IPS mode. Orientation films may be arranged between the liquid crystal layer 70C and the pixel substrate 2 illustrated in FIG. 24, and between the liquid crystal layer 70C and the counter substrate 3 illustrated therein, respectively.

The counter substrate 3 includes the translucent substrate 75 and the color filter 76 formed on one side of the translucent substrate 75. A touch detection electrode TDL serving as a detection electrode of a touch detection device 1 is formed on the other side of the translucent substrate 75, and a polarizing plate 78 is arranged on the touch detection electrode TDL.

The pixel substrate 2 includes the TFT substrate 71 serving as a circuit board, the pixel electrodes 72 arranged in a matrix on the TFT substrate 71, a plurality of common electrodes COML formed between the TFT substrate 71 and the pixel electrodes 72, and the insulating layer 74 that insulates the pixel electrodes 72 from the common electrodes COML. The common electrodes COML are opposed to the pixel electrodes 72 in a direction perpendicular to a surface of the TFT substrate 71. Accordingly, the touch detection device is configured with the common electrodes COML and the touch detection electrode TDL arranged in the counter substrate 3. The touch detection electrode TDL is configured with stripe electrode patterns extending in a direction intersecting with a direction in which the electrode patterns of the common electrodes COML extend. The touch detection electrode TDL is opposed to the common electrodes COML in a direction perpendicular to a surface of the TFT substrate 71. Each electrode pattern of the touch detection electrode TDL is coupled to an input of a touch detection unit (not illustrated). Capacitance is generated at the intersection of the electrode patterns of the common electrode COML and the touch detection electrode TDL that intersect each other.

With this configuration, in performing a touch detection operation for detecting a proximity object, the touch detection device 1 drives the image display panel drive circuit 40 to perform line-sequential scanning on the common electrode COML per block in a time division manner as a control device. Accordingly, each detection block of the common electrode COML is sequentially selected in a scanning direction. In a state in which a finger is in contact with (or close to) the device as the proximity object (contact state), the capacitance affecting the intersection of the common electrode COML and the touch detection electrode TDL is changed as capacitance C2 formed by the finger. The touch detection device 1 outputs the changed capacitance as a touch detection signal from the touch detection electrode TDL. In this way, touch detection per detection block is performed in the touch detection device 1.

Figure 25:
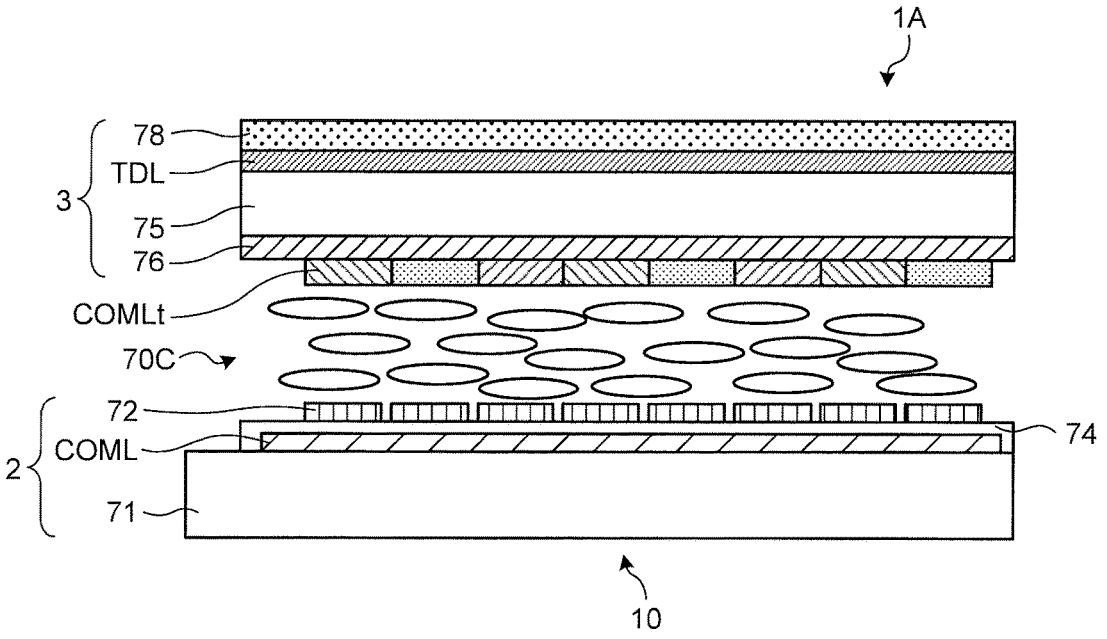
FIG. 25 is a diagram illustrating an example of an electronic apparatus including the display device according to the embodiment.

FIG. 25 is a conceptual diagram of the display device according to the embodiment in which a touch detection device is mounted on the image display panel. The same components as those described above are denoted by the same reference numerals, and redundant description is not repeated here. The display device 10 includes a drive electrode COMLt separately from the common electrode COML. Accordingly, the common electrode COML functions only as the common electrode of the display device 10, and the drive electrode COMLt functions as a drive electrode of a touch detection device 1A.

4. Application Examples

The following describes application examples of the present disclosure in which the display device 10 described above is applied to electronic apparatuses.

FIGS. 26 to 38 are diagrams illustrating examples of an electronic apparatus including the display device according to the embodiment. The display device 10 according to the embodiment can be applied to electronic apparatuses in various fields such as a television apparatus, a digital camera, a notebook-type personal computer, a portable electronic apparatus such as a cellular telephone, or a video camera. In other words, the display device 10 can be applied to electronic apparatuses in various fields that display a video signal input from the outside or a video signal generated inside as an image or a video.

Application Example 1

Figure 26:
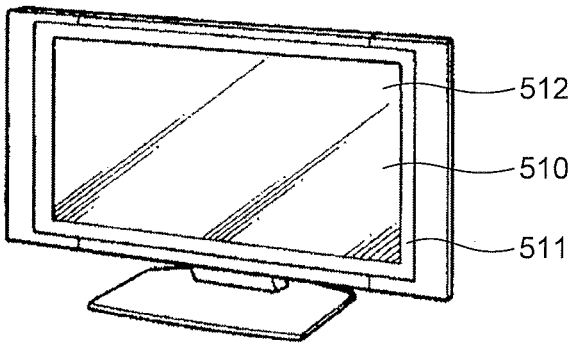
FIG. 26 is a diagram illustrating an example of an electronic apparatus including the display device according to the embodiment.

The electronic apparatus illustrated in FIG. 26 is a television apparatus to which the display device 10 is applied. The television apparatus includes, for example, a video display screen unit 510 including a front panel 511 and a filter glass 512, and the display device 10 is applied to the video display screen unit 510. That is, the screen of the television apparatus may have a function of detecting a touch operation in addition to a function of displaying an image.

Application Example 2

Figure 27:
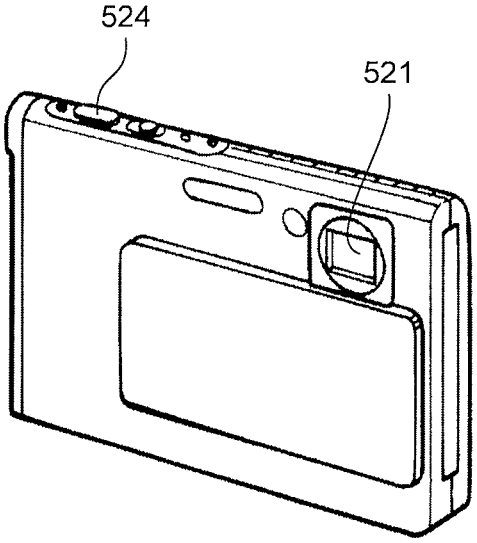
FIG. 27 is a diagram illustrating another example of an electronic apparatus including the display device according to the embodiment.
Figure 28:
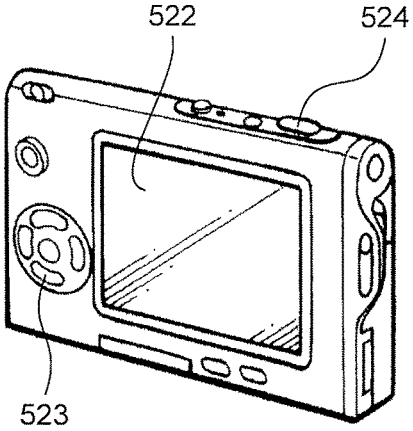
FIG. 28 is a diagram illustrating another example of an electronic apparatus including the display device according to the embodiment.

The electronic apparatus illustrated in FIGS. 27 and 28 is a digital camera to which the display device 10 is applied.

The digital camera includes, for example, a flash light-emitting unit 521, a display unit 522, a menu switch 523, and a shutter button 524, and the display device 10 is applied to the display unit 522. Accordingly, the display unit 522 of the digital camera may have the function of detecting a touch operation in addition to the function of displaying an image.

Application Example 3

Figure 29:
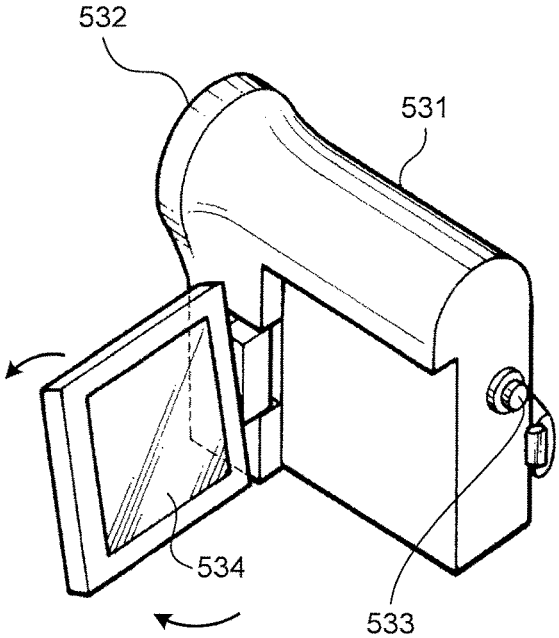
FIG. 29 is a diagram illustrating another example of an electronic apparatus including the display device according to the embodiment.

The electronic apparatus illustrated in FIG. 29 is an external appearance of a video camera to which the display device 10 is applied. The video camera includes, for example, a main body part 531, a lens 532 for photographing a subject arranged on a front side surface of the main body part 531, a start/stop switch 533 for photographing, and a display unit 534. The display device 10 is applied to the display unit 534. Accordingly, the display unit 534 of the video camera may have the function of detecting a touch operation in addition to the function of displaying an image.

Application Example 4

Figure 30:
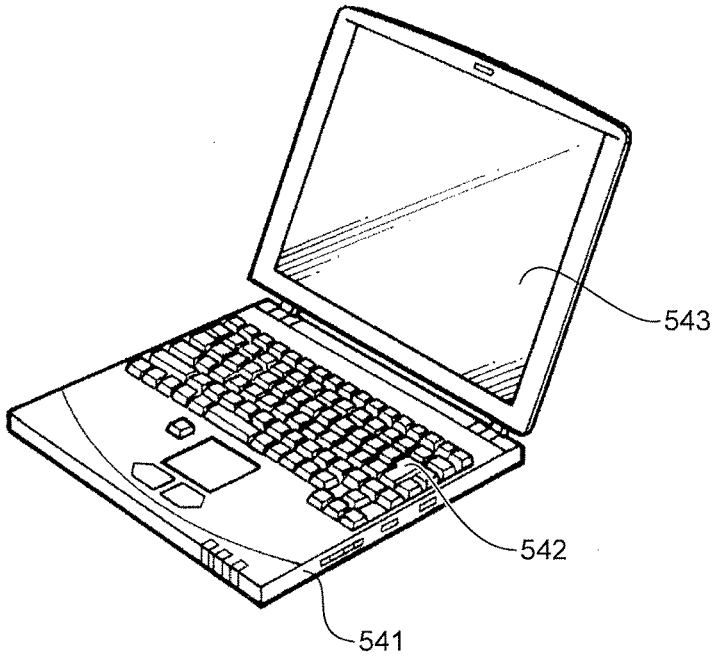
FIG. 30 is a diagram illustrating another example of an electronic apparatus including the display device according to the embodiment.
Figure 31:
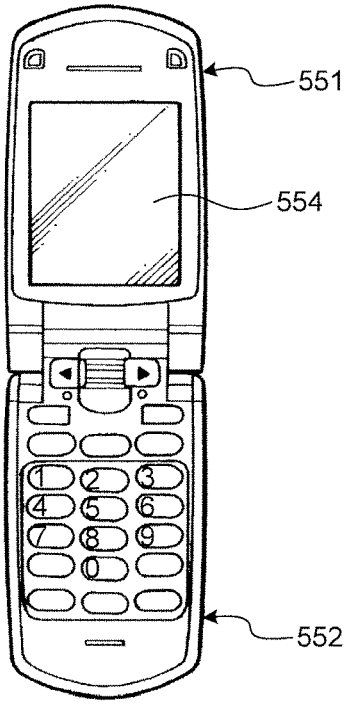
FIG. 31 is a diagram illustrating another example of an electronic apparatus including the display device according to the embodiment.
Figure 32:
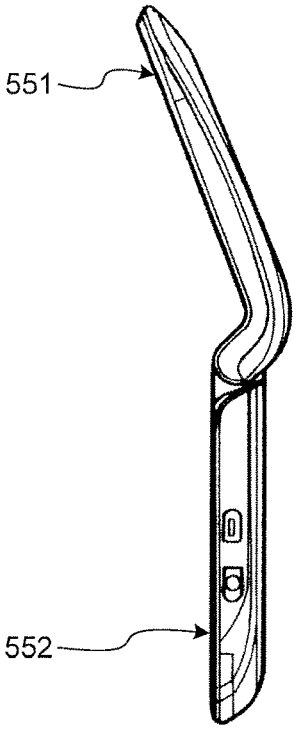
FIG. 32 is a diagram illustrating another example of an electronic apparatus including the display device according to the embodiment.
Figure 33:
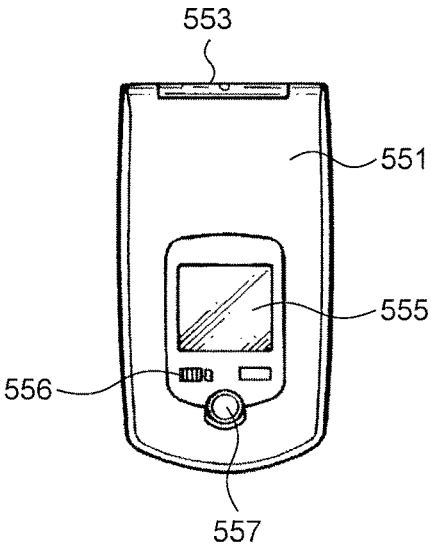
FIG. 33 is a diagram illustrating another example of an electronic apparatus including the display device according to the embodiment.
Figure 34:
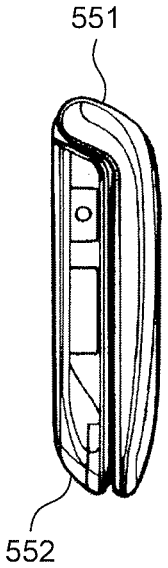
FIG. 34 is a diagram illustrating another example of an electronic apparatus including the display device according to the embodiment.
Figure 35:
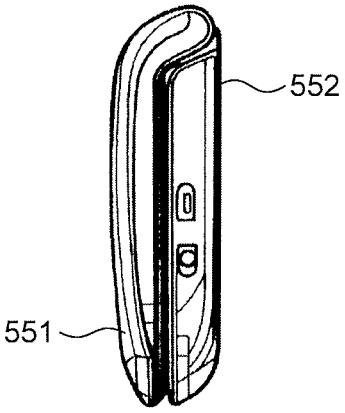
FIG. 35 is a diagram illustrating another example of an electronic apparatus including the display device according to the embodiment.
Figure 36:
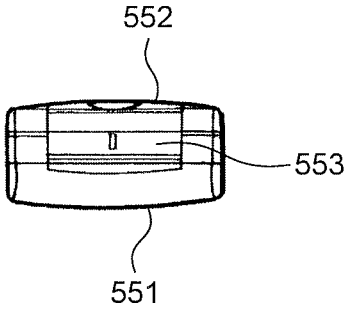
FIG. 36 is a diagram illustrating another example of an electronic apparatus including the display device according to the embodiment.
Figure 37:
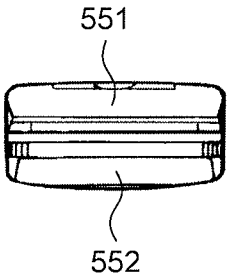
FIG. 37 is a diagram illustrating another example of an electronic apparatus including the display device according to the embodiment.

The electronic apparatus illustrated in FIG. 30 is a notebook-type personal computer to which the display device 10 is applied. The notebook-type personal computer includes, for example, a main body 541, a keyboard 542 for inputting characters and the like, and a display unit 543 that displays an image. The display device 10 is applied to the display unit 543. Accordingly, the display unit 543 of the notebook-type personal computer may have the function of detecting a touch operation in addition to the function of displaying an image.

Application Example 5

The electronic apparatus illustrated in FIGS. 31 to 38 is a cellular telephone to which the display device 10 is applied. The cellular telephone is composed of an upper housing 551 and a lower housing 552 connected together by a connecting part (hinge part) 553, for example, and includes a display device 554, a sub-display device 555, a picture light 556, and a camera 557. The display device 10 is mounted as the display device 554. Accordingly, the display device 554 of the mobile phone may have the function of detecting a touch operation in addition to the function of displaying an image.

Application Example 6

Figure 38:
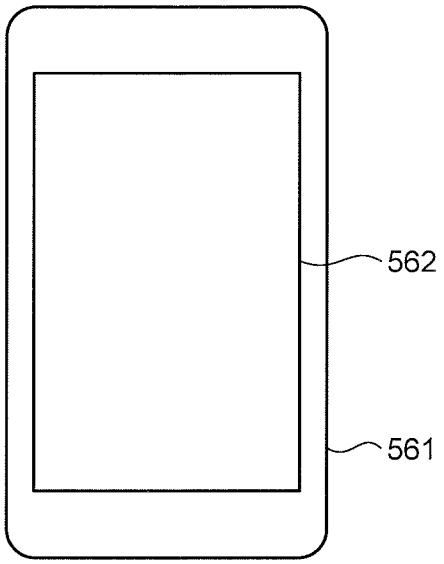
FIG. 38 is a diagram illustrating still another example of the electronic apparatus including the display device according to the embodiment.

The electronic apparatus illustrated in FIG. 38 is an information portable terminal that operates as a portable computer, a multifunctional mobile phone, a mobile computer allowing a voice communication, or a communicable mobile computer, what is called a smartphone or a tablet terminal. The information portable terminal includes a display unit 562 on a surface of a housing 561, for example. The display device 10 is mounted as the display unit 562. The display unit 562 may have the function of detecting a touch operation in addition to the function of displaying an image.

5. Configuration of Present Disclosure

The present disclosure may adopt the following configurations.

(1) A display device includes: an image display panel including: a plurality of pixels arranged in a pixel array including first sub-pixels, second sub-pixels, third sub-pixels, and fourth sub-pixels. The plurality of pixels includes therein, a specified sub-pixel column including the third sub-pixels and the fourth sub-pixels, and at least one sub-pixel column of other sub-pixel columns arranged next to the specified sub-pixel column. The specified sub-pixel column and the one other sub-pixel column are periodically arranged. The display device also includes: a plurality of signal lines provided to the specified sub-pixel columns and the other sub-pixel columns; and a control device that controls the pixels based on image signals. In each of the specified sub-pixel columns, the third sub-pixels and the fourth sub-pixels are alternately arranged in a direction along the corresponding specified sub-pixel column, and the third sub-pixels and the fourth sub-pixels are alternately arranged in a direction along the row direction in each adjacent two of the specified sub-pixel columns. The control device performs column inversion driving (i) to apply a voltage having the same polarity to the signal lines of a first specified sub-pixel column belonging to the specified sub-pixel columns and the other sub-pixel column adjacent to the first specified sub-pixel column, (ii) to apply a voltage having the same polarity as the first specified sub-pixel column to one of the signal lines of a second specified sub-pixel column and a third specified sub-pixel column adjacent to the first specified sub-pixel column in a direction along the row direction, (iii) to apply a voltage having a polarity different from the first specified sub-pixel column to the other signal line, and (iv) to invert the polarities of the voltages to be applied at predetermined cycles.

(2) In the display device according to (1), the control device substantially equalizes a sub-pixel column group, including some of the specified sub-pixel columns, to which a voltage having one polarity is applied and a sub-pixel column group, including others of the specified sub-pixel columns, to which a voltage having the other polarity is applied.

(3) In the display device according to (1) or (2), each of the other sub-pixel columns includes a first sub-pixel column arranged next to the specified sub-pixel column, and the first sub-pixel column includes the first sub-pixels.

(4) In the display device according to (3), each of the other sub-pixel columns includes a second sub-pixel column arranged next to the first sub-pixel column, and the second sub-pixel column includes the second sub-pixels.

(5) In the display device according to (1), the specified sub-pixel column is adjacent to two columns of the other sub-pixel columns. The control device applies a voltage having the same polarity to the signal lines of the specified sub-pixel column and one of the other sub-pixel columns adjacent to the specified sub-pixel column. The control device also applies a voltage having a polarity different from the specified sub-pixel column to the signal line of the other one of the other sub-pixel columns adjacent to the specified sub-pixel column.

(6) In the display device according to any one of (1) to (5), the control device supplies image signals to the signal lines provided to the other sub-pixel columns after supplying image signals to the signal lines provided to some of the specified sub-pixel columns.

(7) A display device includes: an image display panel including a plurality of pixels including first sub-pixels, second sub-pixels, third sub-pixels, and fourth sub-pixels. The plurality of pixels includes therein, first sub-pixel columns including the first sub-pixels, second sub-pixel columns including the second sub-pixels arranged next to the respective first columns, and third sub-pixel columns arranged next to the respective second columns. The first sub-pixel columns to the third sub-pixel columns are periodically arranged. In each of the third sub-pixel columns, the third sub-pixels and the fourth sub-pixels are alternately arranged in a direction along the corresponding third sub-pixel column. One of the third sub-pixels and one of the fourth sub-pixels in each adjacent two of the third sub-pixel columns are alternately arranged in a direction along a row in the same row across the third sub-pixel columns. The display device also includes: signal lines provided to the first sub-pixel columns, the second sub-pixel columns, and the third sub-pixel columns; and a control device that controls the pixels based on image signals. The control device: (i) applies a voltage having the same polarity to the signal lines of adjacent two columns among the first sub-pixel columns to the third sub-pixel columns that are periodically arranged, (ii) applies a voltage having a different polarity to next two columns subsequent to the adjacent two columns, and (iii) inverts the polarities of the voltages to be applied at predetermined cycles.

(8) In the display device according to any one of (1) to (7), a touch detection device that can detect an external proximity object approaching from outside is mounted on or integrated with the image display panel.

The present disclosure has been described above. However, the present disclosure is not limited thereto. The components according to the present disclosure described above include a component that is easily conceivable by those skilled in the art, components that are substantially the same, and components that are within what is called the range of equivalency. The components described above can also be implemented in any appropriate combination. In addition, the components can be variously omitted, replaced, and modified without departing from the gist of the present disclosure.

What is claimed is:

1. A display device comprising:

an image display panel including a plurality of pixels and a plurality of signal lines; and a control device controlling the plurality of pixels based on image signals, wherein the plurality of pixels are arranged in a pixel array and include first sub-pixels, second sub-pixels, third sub-pixels, and white sub-pixels, wherein the plurality of pixels include a specified sub-pixel column including the third sub-pixels and the white sub-pixels, and at least one sub-pixel column of other sub-pixel columns arranged adjacent to the specified sub-pixel column, wherein the specified sub-pixel column and the at least one sub-pixel column are periodically arranged, wherein the plurality of signal lines are provided to the specified sub-pixel columns and the other sub-pixel columns; and wherein, in each of the specified sub-pixel columns, the third sub-pixel and the white sub-pixel are alternately arranged in a direction along the corresponding specified sub-pixel column, wherein, in each row across the specified sub-pixel columns, the third sub-pixel and the white sub-pixel are alternately arranged in a row, wherein the control device performs column inversion driving to apply voltages having the same polarity to the respective signal lines of a first specified sub-pixel column belonging to the specified sub-pixel columns and the other sub-pixel column adjacent to the first specified sub-pixel column, to apply a voltage having the same polarity as the first specified sub-pixel column to the signal line provided to one of a second specified sub-pixel column and a third specified sub-pixel column adjacent to the first specified sub-pixel column in the row direction, to apply a voltage having a polarity different from the first specified sub-pixel column to the signal line provided to the other one of the second specified sub-pixel column and the third specified sub-pixel column, and to invert the polarities of the voltages to be applied at predetermined cycles, wherein the control device supplies voltages such that voltages supplied to all pixels in one sub-pixel column have the same polarity, and wherein, in a case where the control device supplies a first voltage and a second voltage having the same polarity as the first voltage to the respective signal lines provided to the specified sub-pixel column and one of the at least one sub-pixel column, the control device supplies the second voltage to the signal line provided to the one of the at least one sub-pixel column after a time of supplying the first voltage to the signal line provided to the specified sub-pixel column independent of the relative positional order of the specified sub-pixel column and the one of the at least one sub-pixel column within the pixel array.

2. The display device according to claim 1, wherein the control device substantially equalizes a sub-pixel column group, including some of the specified sub-pixel columns, to which a voltage having one polarity is applied and a sub-pixel column group, including others of the specified sub-pixel columns, to which a voltage having the other polarity is applied.

3. The display device according to claim 1, wherein each of the other sub-pixel columns includes a first sub-pixel column arranged next to the specified sub-pixel column, and the first sub-pixel column includes the first sub-pixels.

4. The display device according to claim 3, wherein each of the other sub-pixel columns includes a second sub-pixel column arranged next to the first sub-pixel column, and the second sub-pixel column includes the second sub-pixels.

5. The display device according to claim 1, wherein the specified sub-pixel column is adjacent to two columns of the other sub-pixel columns, the control device applies a voltage having the same polarity to the signal lines of the specified sub-pixel column and one of the other sub-pixel columns adjacent to the specified sub-pixel column, and the control device applies a voltage having a polarity different from the specified sub-pixel column to the signal line of the other one of the other sub-pixel columns adjacent to the specified sub-pixel column.

6. The display device according to claim 1, wherein a touch detection device that is capable of detecting an external proximity object approaching from outside is mounted on or integrated with the image display panel.

7. A display device comprising:

an image display panel including a plurality of pixels and a plurality of signal lines; and a control device controlling the plurality of pixels based on image signals, wherein the plurality of pixels include first sub-pixels, second sub-pixels, third sub-pixels, and white sub-pixels, wherein the plurality of pixels include first sub-pixel columns including the first sub-pixels, second sub-pixel columns including the second sub-pixels arranged adjacent to the respective first columns, and third sub-pixel columns arranged adjacent to the respective second columns, wherein the first sub-pixel columns to the third sub-pixel columns are periodically arranged, wherein, in each of the third sub-pixel columns, the third sub-pixel and the white sub-pixel are alternately arranged in a direction along the corresponding third sub-pixel column, wherein, in each row across the third sub-pixel columns, the third sub-pixel and the white sub-pixel are alternately arranged in a row direction, wherein the signal lines are provided to the first sub-pixel columns, the second sub-pixel columns, and the third sub-pixel columns, wherein the control device:

applies voltages having the same polarity to the respective signal lines of adjacent two columns among the first sub-pixel columns to the third sub-pixel columns that are periodically arranged, applies a voltage having a different polarity to next two columns subsequent to the adjacent two columns, and inverts the polarities of the voltages to be applied at predetermined cycles, wherein the control device supplies voltages such that voltages supplied to all pixels in one sub-pixel column have the same polarity, and wherein, in a case where the control device supplies a first voltage and a second voltage having the same polarity as the first voltage to the respective signal lines provided to the third sub-pixel column and the first sub-pixel column, the control device supplies the second voltage to the signal line provided to the first sub-pixel column after a time of supplying the first voltage to the signal line provided to the third sub-pixel column independent of the relative positional order of the first sub-pixel column and third sub-pixel column within the pixel array.

8. The display device according to claim 7, wherein a touch detection device that is capable of detecting an external proximity object approaching from outside is mounted on or integrated with the image display panel.

* * * * *